US008844741B2

(12) United States Patent
Perelli et al.

(10) Patent No.: US 8,844,741 B2
(45) Date of Patent: Sep. 30, 2014

(54) MODULAR RECYCLING/WASTE SYSTEM

(75) Inventors: Thomas Perelli, Winchester, VA (US); Grant M. Mason, Stephens City, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 468 days.

(21) Appl. No.: 12/612,324

(22) Filed: Nov. 4, 2009

(65) Prior Publication Data

US 2010/0116822 A1 May 13, 2010

Related U.S. Application Data

(60) Provisional application No. 61/198,684, filed on Nov. 7, 2008.

(51) Int. Cl.

| | |
|---|---|
| ***B65D 21/02*** | (2006.01) |
| ***B65F 1/14*** | (2006.01) |
| ***B65F 1/06*** | (2006.01) |
| *B65F 1/00* | (2006.01) |

(52) U.S. Cl.

CPC ..... *B65F 1/0053* (2013.01); *B65F 1/1415* (2013.01); *B65F 2001/0086* (2013.01); *B65F 1/06* (2013.01); *B65F 2220/101* (2013.01); *B65F 1/1607* (2013.01)

USPC ..... 220/23.4; 220/4.28

(58) Field of Classification Search

USPC ..... 220/495.08, 23.4, 23.2, 4.34, 4.31, 220/4.03, 4.28, 495.11, 685; 206/509, 600

See application file for complete search history.

(56) References Cited

U.S. PATENT DOCUMENTS

| | | | | |
|---|---|---|---|---|
| 1,021,872 | A | | 4/1912 | Kingsbury |
| 3,803,738 | A | * | 4/1974 | Weiss ..... 40/306 |
| 4,971,202 | A | | 11/1990 | Box |
| 4,982,857 | A | | 1/1991 | Sher |
| 4,991,737 | A | | 2/1991 | Edelman |

(Continued)

FOREIGN PATENT DOCUMENTS

| | | |
|---|---|---|
| DE | 29510332 | 9/1995 |
| EP | 1435327 | 7/2004 |
| GB | 2441884 | 3/2008 |

OTHER PUBLICATIONS

Rubbermaid Commercial Products, LLC et al., International Application No. PCT/US2009/063504, International Preliminary Report on Patentability/Written Opinion, May 19, 2011, 7 pages.

(Continued)

*Primary Examiner* — Jeffrey Allen

(74) *Attorney, Agent, or Firm* — Steven B. Phillips; Moore & Van Allen PLLC

(57) ABSTRACT

A recycling/waste assembly comprises a plurality of base units, each comprising a base connection mechanism for connecting the base units to one another. The base units have a first wall connector for connecting each of the base units to at least one of a plurality of wall units. The assembly also comprises a plurality of top units, each comprising a top connection mechanism for connecting the top units to one another. The top units have a second wall connector for connecting the top units to the wall units. The top units comprise an opening and a lid for covering the opening. The wall units are engageable with the first wall connector and the second wall connector. The wall units also comprise wall connections for connecting the wall units to one another.

25 Claims, 20 Drawing Sheets

(56) References Cited

U.S. PATENT DOCUMENTS

| | | | | |
|---|---|---|---|---|
| 5,022,548 | A | 6/1991 | Stakis | |
| 5,072,852 | A | 12/1991 | Smith et al. | |
| 5,108,000 | A | 4/1992 | Stoll et al. | |
| 5,111,958 | A | 5/1992 | Witthoeft | |
| D329,313 | S | 9/1992 | Ward et al. | |
| 5,167,343 | A | 12/1992 | Winfrey et al. | |
| 5,239,729 | A | 8/1993 | Scholl | |
| 5,284,268 | A | 2/1994 | Marsan et al. | |
| 5,381,921 | A | 1/1995 | Bray et al. | |
| 5,445,397 | A | 8/1995 | Evans | |
| 5,476,187 | A * | 12/1995 | Marisco | 220/495.08 |
| 5,611,270 | A | 3/1997 | Harrington | |
| 5,765,707 | A * | 6/1998 | Kenevan | 220/4.28 |
| 6,062,416 | A | 5/2000 | Smillie | |
| 6,209,978 | B1 | 4/2001 | Khan | |
| 6,276,553 | B1 | 8/2001 | Vulcano | |
| 6,415,495 | B1 * | 7/2002 | Delmerico et al. | 29/434 |
| 6,540,103 | B2 | 4/2003 | Silvers | |
| D481,509 | S | 10/2003 | Perelli | |
| 7,290,674 | B1 | 11/2007 | Ledford | |
| D586,972 | S | 2/2009 | Yang et al. | |
| 7,497,332 | B1 * | 3/2009 | Schwimmer | 206/600 |
| 7,500,579 | B2 | 3/2009 | Crossley | |
| 7,648,407 | B1 * | 1/2010 | Sorensen | 446/120 |
| D618,417 | S | 6/2010 | Presnell | |
| 8,006,859 | B2 | 8/2011 | Clarke | |
| 2003/0178430 | A1 | 9/2003 | Wentz et al. | |
| 2005/0016999 | A1 * | 1/2005 | Richardson et al. | 220/4.28 |
| 2008/0283526 | A1 * | 11/2008 | Buchanan | 220/23.4 |
| 2009/0218341 | A1 * | 9/2009 | Wu | 220/4.28 |
| 2012/0118784 | A1 | 5/2012 | Decker et al. | |

OTHER PUBLICATIONS

Rubbermaid Commercial Products, LLC, International Search Report for International Application No. PCT/US2009/063504, filed Nov. 6, 2009, date of mailing Mar. 1, 2010, 7 pages.

Rubbermaid Commercial Products, LLC, International Written Opinion for International Application No. PCT/US2009/063504, filed Nov. 6, 2009, date of mailing Mar. 1, 2010, 7 pages.

* cited by examiner

MODULAR RECYCLING/WASTE SYSTEM

This application claims benefit of priority under 35 U.S.C. §119(e) to the filing date of to U.S. Provisional Application No. 61/198,684, as filed on Nov. 7, 2008, which is incorporated herein by reference in its entirety.

The invention relates to waste containers and more particularly to a modular assembly that is suitable for use as a recycling/waste container.

BACKGROUND

Waste and recycling containers typically comprise a stand alone container body that has an opening allowing access to the interior of the container body. The container body may hold a plastic bag or other removable liner that communicates with the opening such that waste deposited in the container is collected in the removable liner.

SUMMARY

A recycling/waste assembly comprises a plurality of base units. At least one base connection mechanism is provided on the base units for connecting each of the base units to another one of the base units. The base units also comprise a first wall connector for connecting each of the base units to a wall unit. A plurality of top units are provided each having at least one top connection mechanism for connecting each of the top units to another one of the top units. The top units have a second wall connector for connecting each of the top units to a wall unit. The top units comprise an opening for receiving waste material. A lid may selectively cover the opening. The lid may include a second opening. A plurality of wall units each having a top edge, a bottom edge, a first side edge and a second side edge are engageable with the first wall connector and the second wall connector. The wall units may comprise a wall connection mechanism for connecting adjacent wall units to one another.

The base connection mechanism and top connection mechanism may comprise a slot and a flexible locking tab positioned such that the locking tab of one of the plurality of base units and top units is disposed directly opposite the slot of an adjacent base unit and top unit, respectively. The base connection mechanism may fix the base units together by moving the base units toward one another to create a snap-fit connection. Likewise, the top connection mechanism may fix the top units together by moving the top units toward one another to create a snap-fit connection. The locking tab may comprise a resilient finger that engages the slot when the base units are moved into engagement with one another. Likewise, the wall connection mechanisms may comprise a plurality of locking tabs along a first side edge of the wall units and a first and second set of mating slots along the other side edge of the wall units. The first set of mating slots is provided on a surface that is disposed substantially parallel to a face of the wall unit and the second set of mating slots is provided on a surface that is disposed substantially perpendicular to the face of the wall unit.

The first wall connector may comprise a channel that receives the bottom edge of a wall unit and a locking member that engages a flange disposed along the bottom edge of the wall unit. The second wall connector may also comprise a channel that receives the top edge of a wall unit and a locking member that engages a flange disposed along the top edge of the wall unit.

A latch located adjacent the first side edge of the wall unit and a recess engageable by the latch located adjacent the second side edge of the wall unit connect the top and bottom edges of the wall units to one another. The latch may comprise a resilient member that extends beyond the first side edge of the wall unit on which it is mounted and has a protrusion that engages the recess on an adjacent wall unit.

A wall panel may be mounted to an inside surface of the wall units to give a smooth interior surface to ease bag liner removal and separate the units from one another. Decorative inserts may be attached to an outer face of the wall units and or lids. The base units, wall units and top units may be made of molded plastic. Support columns may extend between a base unit and a top unit.

To hold a bag liner in the assembly one of the top units may include a first bale and a second bale pivotably mounted to the top unit. The first bale may extend for a first portion of a periphery of the opening in the top unit and the second bale may extend for a second portion of the periphery of the opening. A ledge may support the first bale and the second bale and locking members may trap the first bale and the second bale against the ledge.

A method of assembling a recycling system is also provided. The method may comprise selecting a plurality of base units including selecting at least one type of base unit from a plurality of different types of base units; selecting a plurality of top units including selecting at least one type of top unit from a plurality of different types of top units; selecting a plurality of wall units; connecting the plurality of base units together using a snap fit connection; connecting the plurality of wall units to one another and connecting the assembled wall units to the base units using a snap fit connection; and connecting the plurality of top units to one another and to the wall units using a snap fit.

DETAILED DESCRIPTION OF PREFERRED EMBODIMENTS

The modular recycling/waste system allows a user to create a variety of containers from selected modular components to meet the user's specific needs. The system also provides an inexpensive way to satisfy a user's recycling and waste needs. The modular system also allows the assembled system to be custom fit to a particular area or architecture. The system also provides a connected system where the different containers do not get separated, moved or lost. The system is also differentiated by appearance and function from refuse only containers.

Referring to the figures, the system comprises a system of base units, wall units and top units that can be combined or interchanged with other similar units to create different shapes, sizes and quantities of containers in one system. The system uses modular components that can be assembled together in multiple ways.

Figure 1:
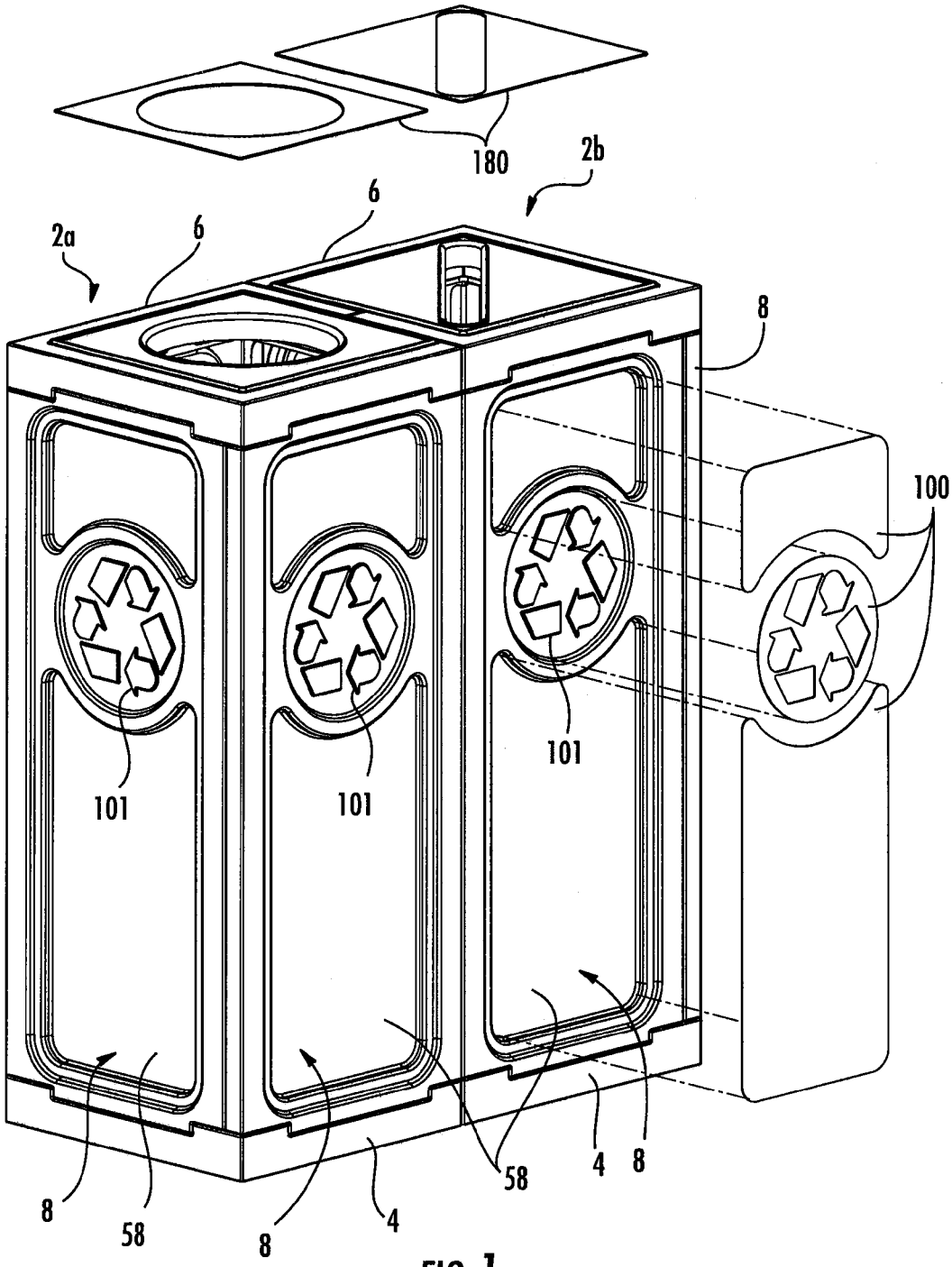
FIG. 1 is a perspective view of an embodiment of an example configuration of the assembled system.
Figure 2:
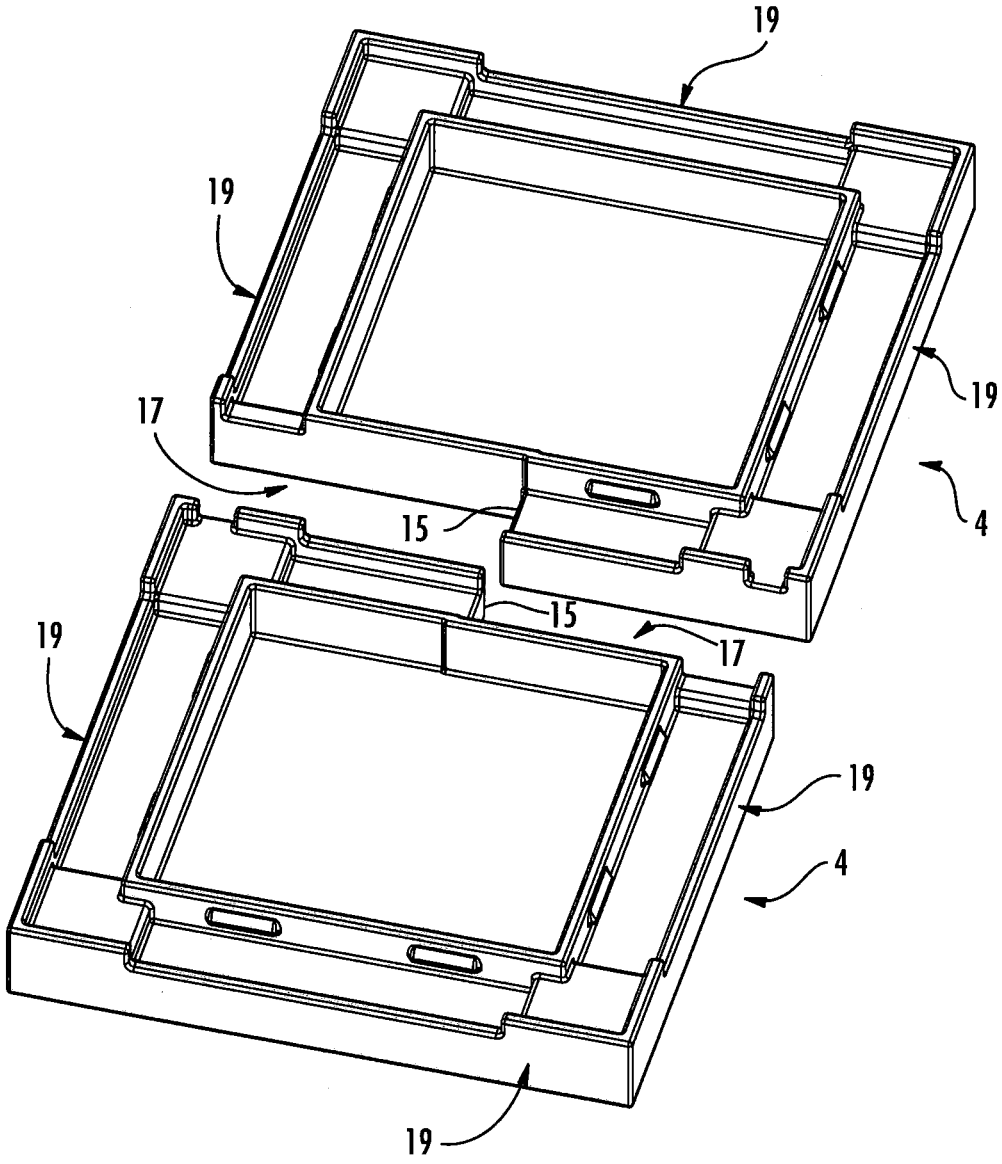
FIG. 2 is a perspective schematic view of the base units arranged as used in the configuration of the system shown in FIG. 1.

Referring to FIGS. 1 and 2, an example configuration of the system is shown comprising two subsystems 2*a* and 2*b* connected together to create a complete system. Each subsystem comprises a base unit 4, a top unit 6 and at least one wall unit 8. The base unit, top unit and wall units of one subsystem are connected together and are connected to the base unit, top unit and wall units of the adjacent subsystem. In one embodiment the base units, wall units and top units are made of a molded plastic. The molded plastic is resilient allowing the members to be fit together, deformed and locked to one another as described. The molded plastic also allows symbols, emblems, words or other indicia to be molded into base unit, wall unit and top unit. The indicia may be decorative or it may provide information to the user such as what types of material may be discarded in each subsystem.

Figure 3:
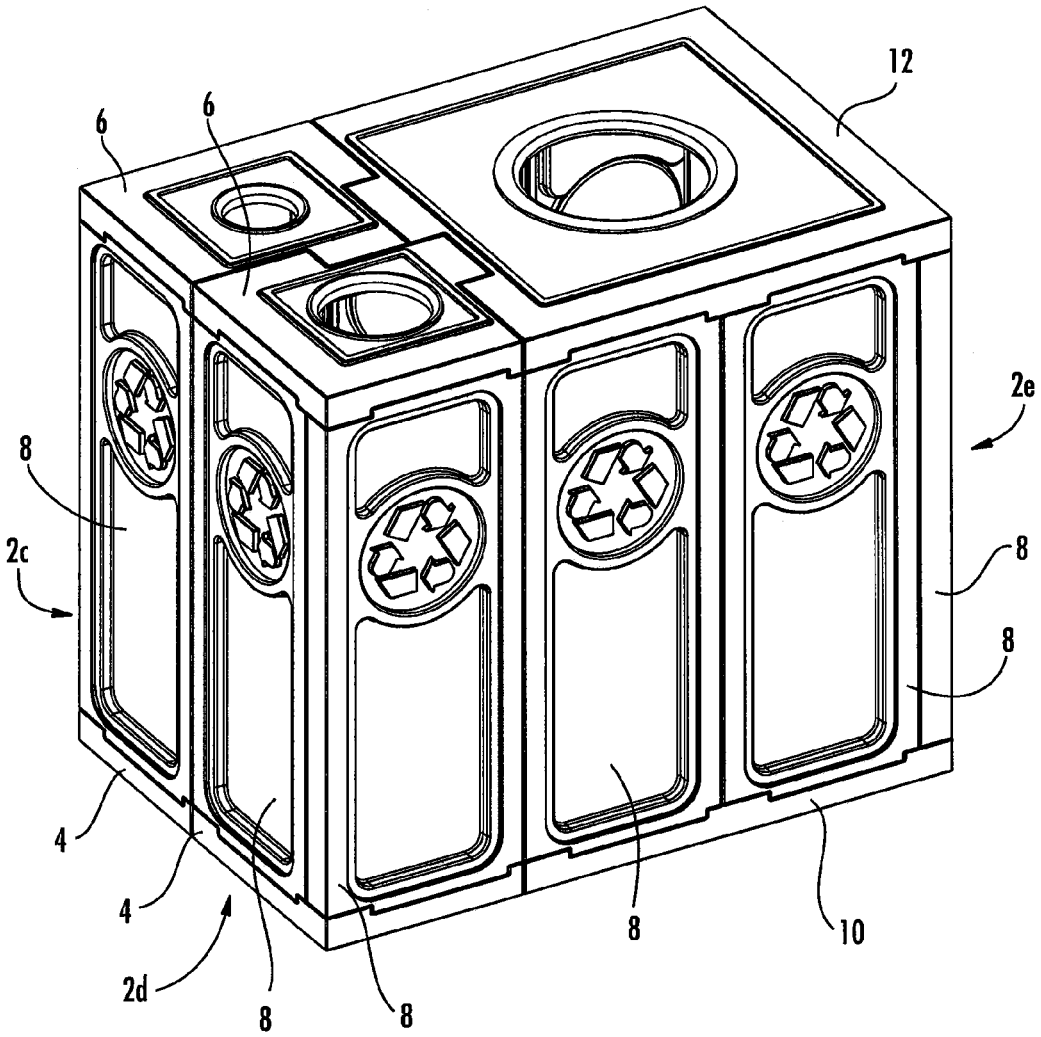
FIG. 3 is a perspective view of an embodiment of another example configuration of the assembled system.
Figure 4:
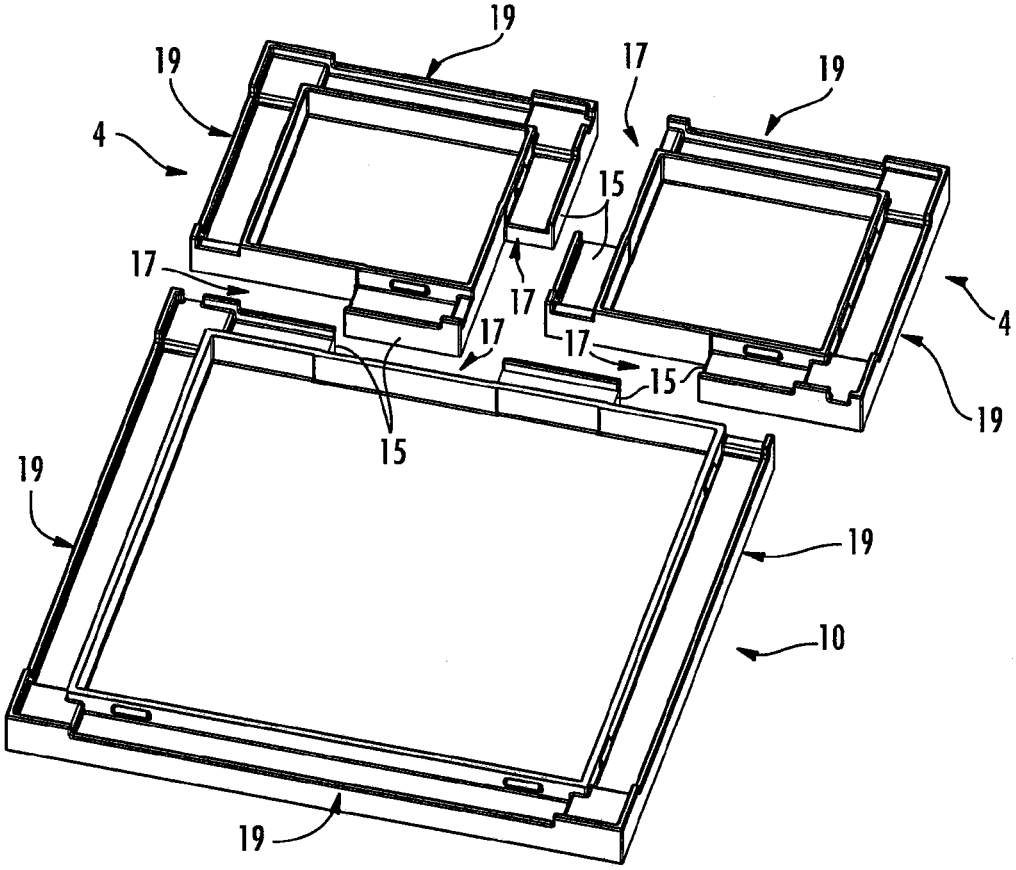
FIG. 4 is a perspective schematic view of the base units arranged as used in the configuration of the system shown in FIG. 3.

Referring to FIGS. 3 and 4, another example configuration of the system is shown comprising three subsystems 2*c*, 2*d* and 2*e* connected together to create a complete system. Each of subsystems 2*c* and 2*d* comprise a base unit 4, a top unit 6 and at least one wall unit 8. Subsystem 2*e* comprises wall units 8, a base unit 10 and a top unit 12. The base unit 10 and top unit 12 being equal in size to four of the small subsystems 2*c* and 2*d*. The base unit, top unit and wall units of one subsystem are connected together and are connected to the base unit, top unit and wall units of the adjacent subsystem.

Figure 5:
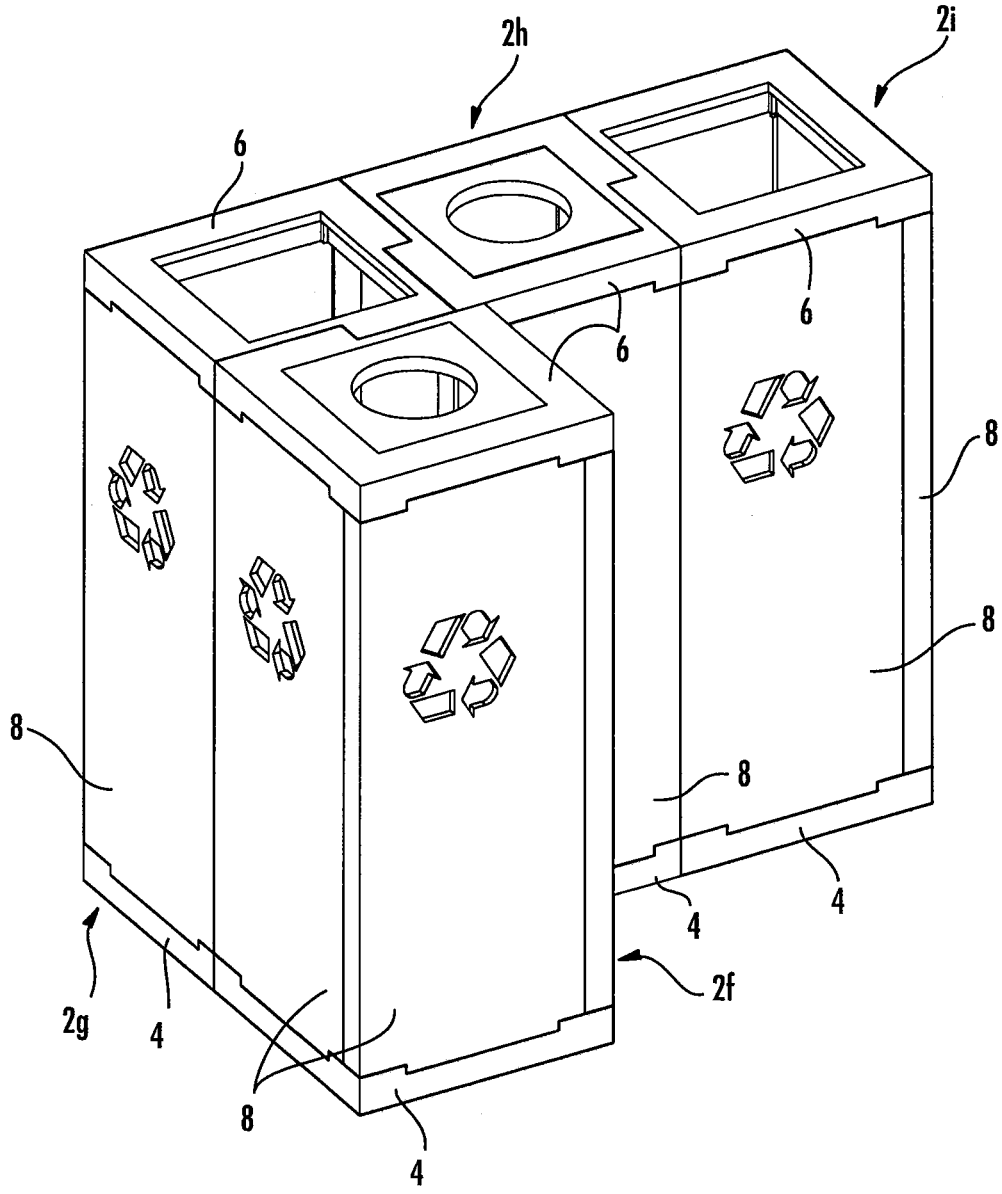
FIG. 5 is a perspective view of an embodiment of yet another example configuration of the assembled system.

Referring to FIG. 5, an example configuration of the system is shown comprising four subsystems 2*f*, 2*g*, 2*h* and 2*i* connected together to create a complete system where the system is L-shaped. Each subsystem comprises a base unit 4, a top unit 6 and at least one wall unit 8. The base unit, top unit and wall units of one subsystem are connected together and are connected to the base unit, top unit and wall units of the adjacent subsystem.

Figures 6A, 6B, 6C, 6D, 6E, 6F, 6G, 6H, 6I:
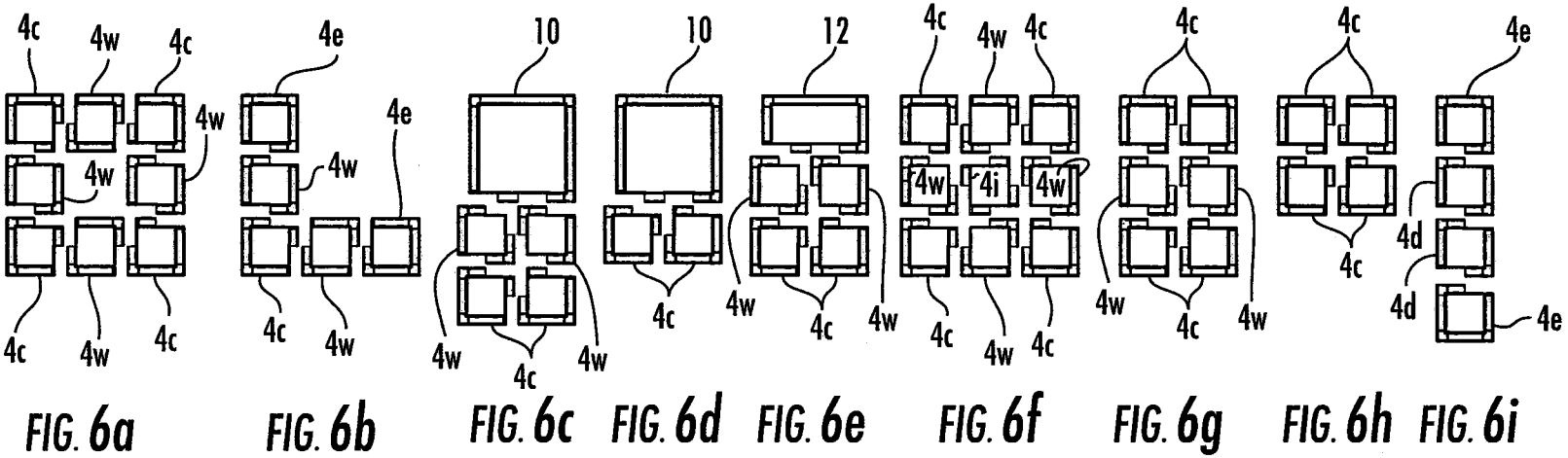
FIGS. 6*a* through 6*i* are schematic plan views of the base units arranged in various example configurations.

FIGS. 6*a* through 6*i* show the subsystems arranged, but not connected together, in various example configurations. Numerous other configurations can also be made using the modular system and the illustrated configurations are not intended to be limiting. FIG. 6*a* shows an eight subsystem configuration arranged such that an open area is located in the middle of the complete system. FIG. 6*b* shows a five subsystem configuration arranged in an L-shape. FIG. 6*c* shows a system similar to that previously described with reference to FIG. 3 with two additional subsystems. FIG. 6*d* shows a system like that previously described with reference to FIG. 3. FIG. 6*e* shows a system similar to that of FIG. 6*c* except that the larger subsystem is equal to two times the area of the smaller subsystems. FIG. 6*f* shows a nine subsystem configuration arranged as a square. FIG. 6*g* shows a six subsystem configuration arranged as a rectangle. FIG. 6*h* shows a four subsystem configuration arranged as a square. FIG. 6*i* shows a four subsystem configuration arranged in a line.

In one embodiment of the invention the larger units are multiples of the smallest units. For example, in the illustrated embodiment the large unit 10 is equal in size to four of the smallest units; the mid-size unit 12 is equal in size to two of the smallest units; and the large unit 10 is equal in size to two of the midsize units 12. By scaling the larger units up in integer multiples of the smallest units, the different size components can be easily fit together to create an assembled system of virtually any size and shape. The illustrated embodiments use a single size wall unit 8 sized to match the smallest base unit to simplify manufacture, but a selection of sizes of the wall units scaled up in integer multiples of the smallest wall unit size may also be used. For example, referring to FIG. 3, the wall unit used with base unit 10 may be twice the size of the smallest wall unit 8 and extend the full width of the base unit. Further, multiples of the smaller base units may be connected together to create the base unit for a subassembly that uses a larger size top unit.

Referring to FIGS. 2 and 4 each of the base units includes a combination of finished sides 19 and/or connecting sides 17. Finished sides 19 are the sides of the base unit that face the exterior of the assembled system and do not include base connection mechanisms 15 for connecting one base unit to another base unit. Connecting sides 17 are the sides that face adjacent base units and include base connecting mechanisms 15 for connecting one base unit to the adjacent base unit. The connecting sides 17 and finished sides 19 are arranged and configured such that the base connection mechanisms 15 of one subsystem face and connect to the connection mechanisms 15 of the adjacent subsystem to join the systems together while the finished sides face the exterior of the complete system. The structure and operation of the base connecting mechanisms 15 will be described in detail hereinafter.

Referring, for example, to FIG. 4, the larger base units 10 and 12 include multiples of the base connection mechanisms 15 such that the connecting side 17 of a base unit 10 that is two times the size of the smallest unit 4 includes two base connection mechanisms 15 on the connecting side 17 such that the larger base unit can be connected to two of the smaller base units. Likewise, a unit that is three times the size of the smallest unit has three base connection mechanisms 15 on one connecting side 17 such that the larger base unit can be connected to three of the smaller base units. The finished sides 19, in addition to not having the base connection mechanisms 15, also may have a surface finish to enhance the appearance of the exposed surfaces. For examples, these sides may be painted, coated, embossed or the like. The surface finish does not have to extend to the non-exposed surfaces because these surfaces will not be visible in the complete system; however, the non-exposed surfaces may be finished if desired.

Referring to FIGS. 6*a* through 6*i*, some of the subsystems form outside corners, other of the subsystems form outside walls and still other of the subsystems form only interior structure. Referring for example to FIG. 6*f*, four corner subsystems 4*c* are shown, one located at each corner of the complete system, four outside wall subsystems 4*w* are shown, one located between each two of the corner units, and one interior subsystem 4*i* is shown, located in the interior of the completed system. The base units and top units for each of these different types of subsystems are configured slightly differently. The base units and top units of the corner subsystems 4*c* have two adjacent finished sides and two adjacent connecting sides. The base units and top units of the outside wall subsystems 4*w* have one finished side facing the outside of the completed system and three connecting sides. The base units and top units of the interior subsystems 4*i*have four connecting sides.

Referring for example to FIG. 6*i*, two end subsystems 4*e* are shown, one located at each end of the complete system and two double outside wall subsystems 4*d* are shown located between the end subsystems 4*e*. The base units and top units for each of these different types of subsystems are configured slightly differently. The base units and top units of the end subsystems 4*e* have three adjacent finished sides and one connecting side. The base units and top units of the double outside wall subsystems 4*d* have two opposed finished sides facing the outside of the system and two opposed connecting sides.

Figure 7:
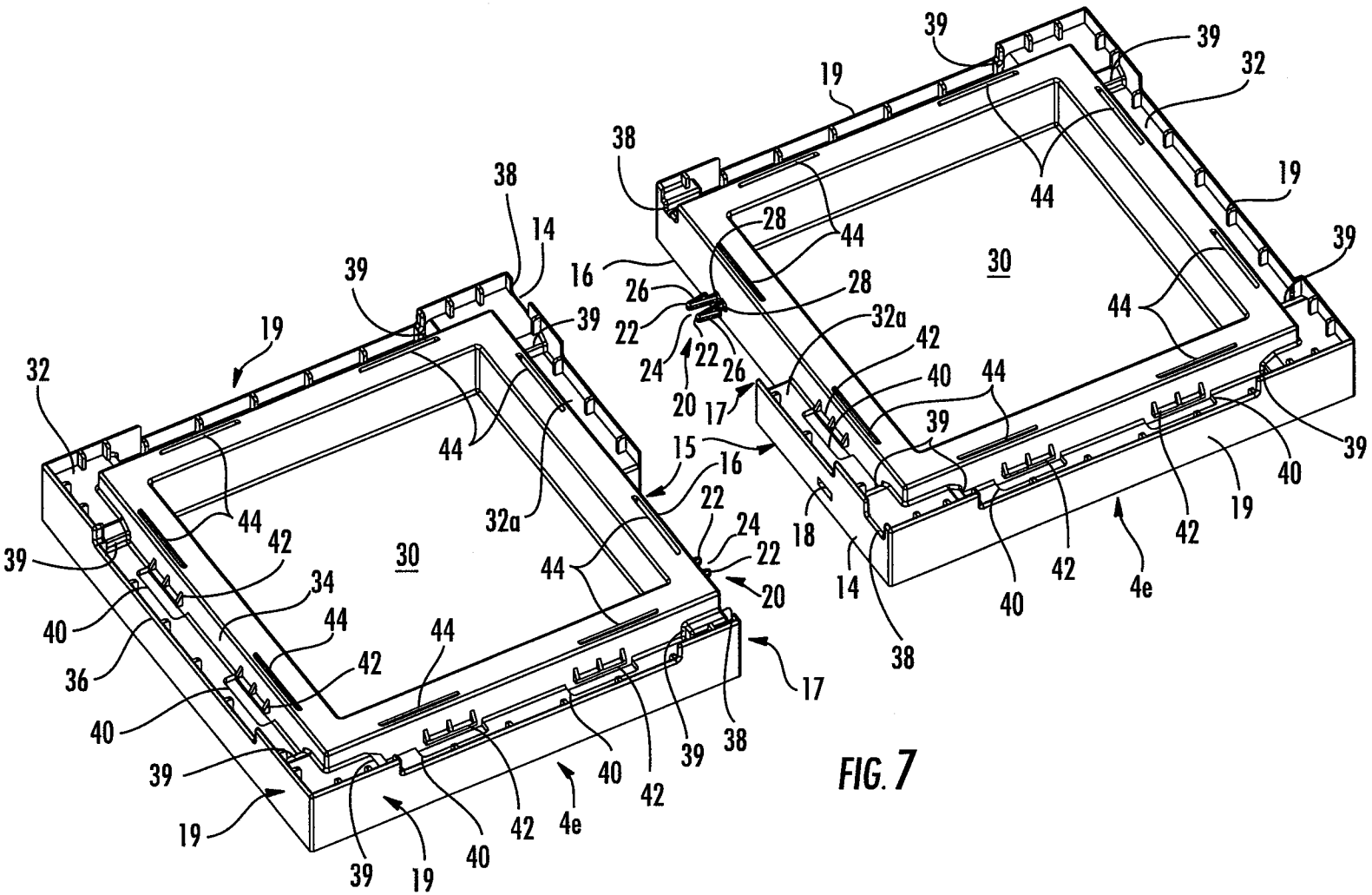
FIG. 7 is a more detailed perspective view of two of the base units.

Referring to FIG. 7, two base units 4*e* are shown configured for a two subsystem system such as shown in FIG. 1. In such a configuration three sides 19 of each base unit 4*e* are finished sides and are exposed in the completed system. One side of each base unit 4*e* is a connecting side 17 and includes base connection mechanism 15 for joining the base units together.

Each base unit further includes a bottom panel 30 that defines the bottom of the subassembly and a channel 32 that surrounds the base unit except in the area of recessed section 16. The channel is open toward its top and is defined by an inner wall 34 and outer wall 36. Outer wall 36 may be formed as an extension of the finished sides 10 and the outer wall of the protruding section 14. When adjacent base units are brought into engagement with one another, the protruding section 14 of one base unit extends into the recessed section 16 of the other base unit such that the channel sections 32*a* on the two base units align with one another to create a channel that extends for the length of the abutting base units.

Further, on the connecting sides 17 a section of the outer wall 36 is cut out as shown at 38 to allow the wall units 8 to sit in the channels 32 and span adjacent base units. Also, along each side of the base unit, the channel 32 has a stepped profile 39 to seat the mating wall unit 8 in channel 32.

Locking members 42 are formed on interior wall 34 at spaced locations in channel 32 around the periphery of the base unit. Locking members 42 fix the wall units 8 to the base units 4 as will hereinafter be described. Locking members 42 are formed as protrusions extending from wall 34. Located below locking members 42 are slots 40. The combination of channels 32 and locking members 42 comprises a wall connector for connecting the base units to the wall units 8.

A series of slots 44 are formed on the bottom 30 of the base units at spaced locations around the periphery of the base unit. Slots 44 are used to fix interior wall panels to the base unit as will hereinafter be described.

The base connection mechanism 15 on connecting sides 17 is arranged with the protruding section 14 extending beyond recessed area 16 such that the connecting side 17 has a stepped profile. The location of the protruding section 14 and recessed section 16 on the connecting side of the adjacent base unit is asymmetrical such that the protruding section 14 of one base unit is disposed opposite to the recessed section 16 of the adjacent connecting side. In the embodiment of FIG. 7 the illustrated base units are actually identical to one another such that one base unit is rotated 180 degrees relative to the other base unit. When the base units 4 are brought into engagement with one another, the protruding sections 14 extend into recessed sections 16 to position and partially fix the base units 4 in position relative to one another. The asymmetric configuration of the recessed and protruding sections allows the units to be connected in a variety of configurations.

To further lock the base units to one another, the base connection mechanism 15 includes a slot 18 formed in one of protruding section 14 and recessed section 16 and a flexible locking tab 20 is formed in the other of protruding section 14 and recessed section 16. In the illustrated embodiment slot 18 is formed in protruding section 14 and flexible locking tab 20 is formed in recessed section 16. The slots 18 and tabs 20 are arranged with the tab 20 of one base unit disposed directly opposite the slot 18 of the adjacent base unit such that when the base units are brought into engagement with one another the tab 20 on one base unit enters and engages the slot 18 of the adjacent base unit. The adjacent base units can be fixed to one another simply by pushing the base units toward one another to engage the locking tabs 20 with the opposed slots 18 using a "snap-fit" connection. The engagement of the locking tabs with the slots fixes the adjacent base units to one another without the need for tools or separate fasteners by simply moving the base units toward and into engagement with one another.

The locking tabs 20 comprise a pair of relatively resilient fingers 22 disposed adjacent one another and having a space 24 therebetween. The outer edge 26 of each finger 22 is angled relative to the direction of insertion of the tab 20 into the slot 18 to form a camming surface that engages the edge of the mating slot when the base units are moved into engagement with one another. The engagement of the edges of the slots 18 with the camming surfaces 26 forces the fingers 22 toward one another such that the locking tab 20 is able to enter the slot 18. Each finger 22 is formed with an undercut area 28 such that when the tab 20 is fully inserted into the slot 18, the fingers 22 can resiliently move back to the undeformed position where the edges of the undercut areas 28 engage the back of the wall that forms slot 18 to lock the base units to one another. To unlock the base units from one another, the bottom of the base unit is accessed, the fingers 22 are forced toward one another such that the tabs 20 can be removed from the slots 18.

Figure 8:
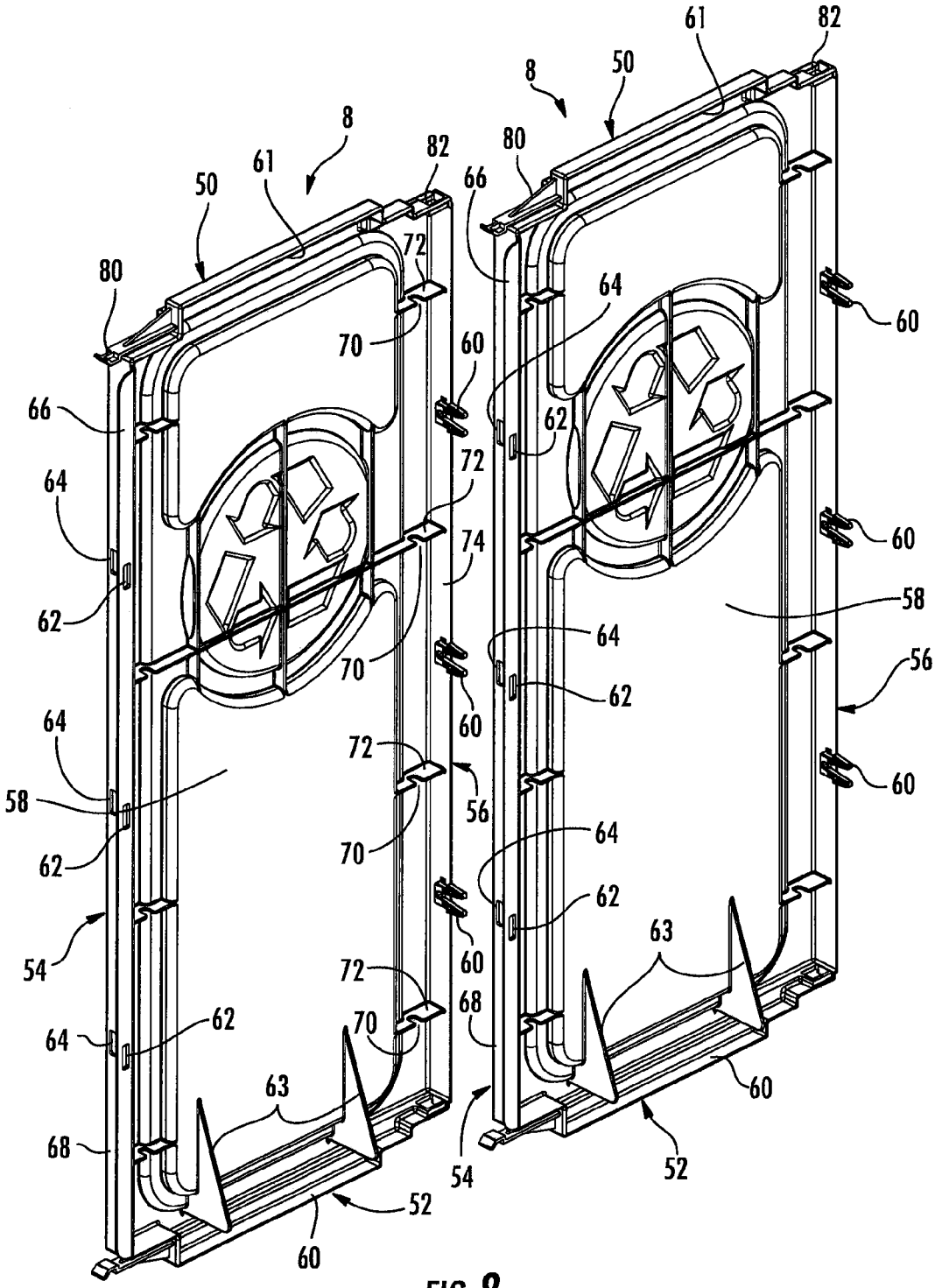
FIG. 8 is a more detailed perspective view of two of the wall units.
Figure 9:
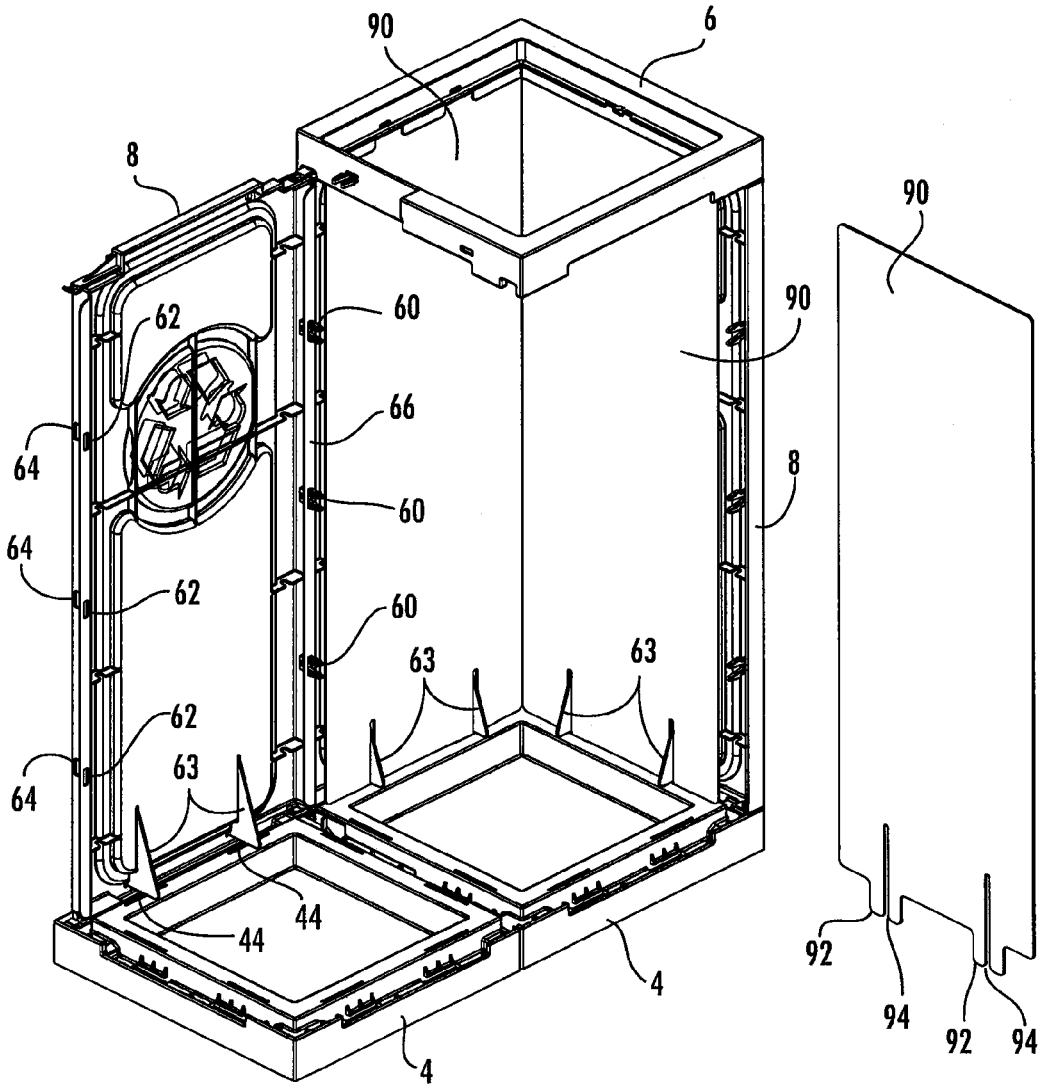
FIG. 9 is a perspective view showing a partially assembled system.
Figure 10:
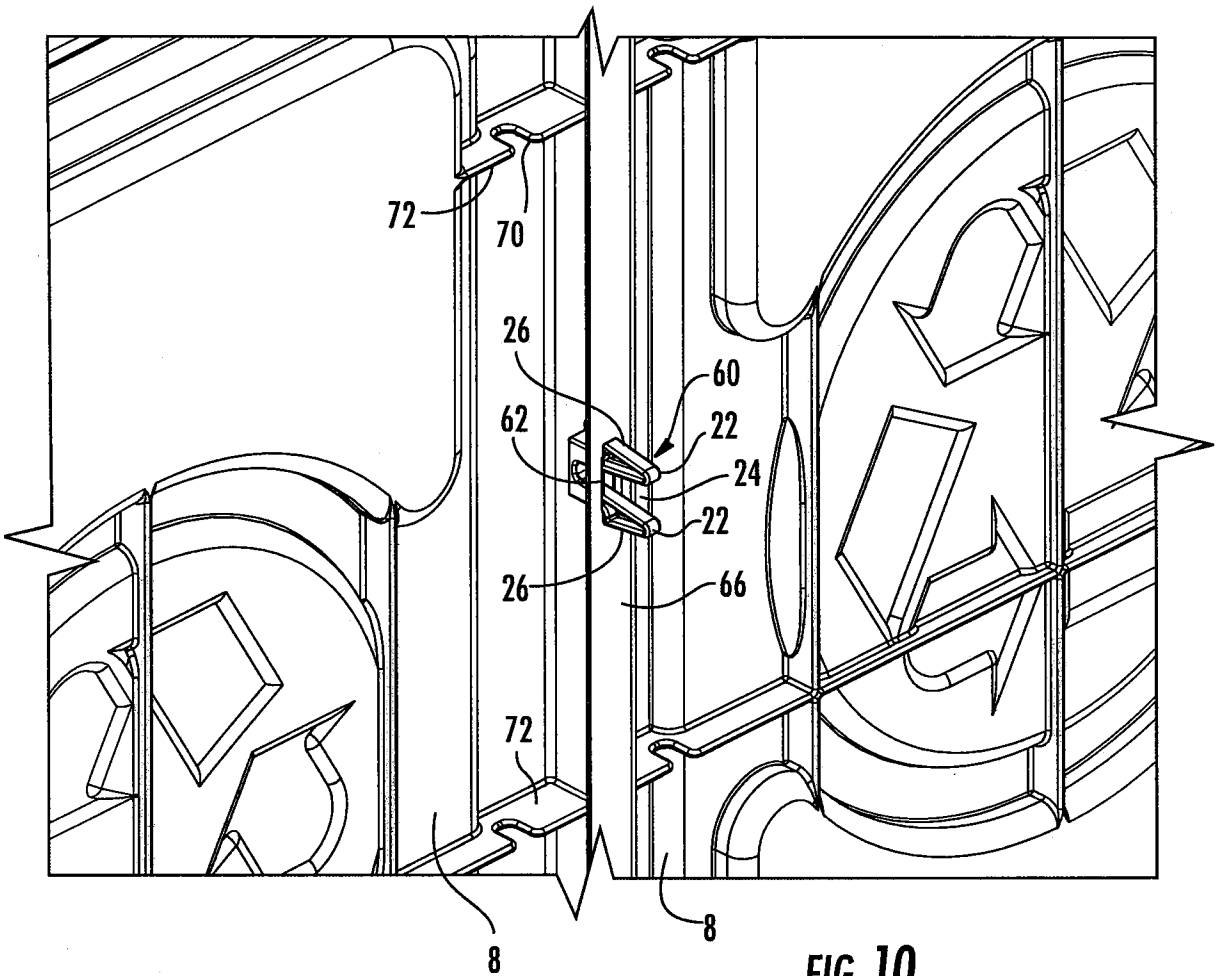
FIGS. 10, 11 and 12 are partial perspective views showing the connection mechanism between wall units.

Referring to FIGS. 8, 9 and 10, wall units 8 are shown, each wall unit having a substantially planar configuration with a top edge 50, bottom edge 52, first side edge 54, second side edge 56 and face 58. The wall unit 8 is approximately the same width as the finished side 19 of a base unit 4 and may have any suitable height. One wall unit can be used to fill one side of the smallest base unit and multiple wall units can be used to fill one side of each of the larger base units. For example, referring to FIG. 3, a 4× subassembly 2*e* may use two wall units 8 on each side of the base unit 10. A 6× subassembly may use three wall units for each side of the base unit.

The bottom edge 52 may have a stepped profile that is dimensioned to fit into channel 32 of the base units along one finished side of the base unit as shown in FIG. 9. The bottom edge 52 is formed with a bottom flange 60 that can resiliently deform such that when the bottom edge 52 is placed into channel 32 and a downward force is applied, the bottom flange 60 deforms and is forced around locking members 42 until the bottom edge is seated in the bottom of channel 32. Locking members 42 are spaced from the bottom of channel 32 such that the bottom flange 60, after it has cleared locking members 42, can return to its undeformed state where it is located under locking members 42. The engagement of locking members 42 with bottom flange 60 locks the wall units 8 into the base units using a snap-fit connection. As shown in FIG. 7, the top of locking members 42 may be formed with angled camming surfaces that facilitate the deformation of the bottom flange 60 when the wall unit 8 is forced into channel 32. Slots 40 are located below locking members 42 to allow a tool such as a screwdriver to be inserted into the slots 40 from the bottom of the base unit to release the bottom flange 60 from the locking members 42. The wall units 8 may be provided with webs 63 that engage the base unit to increase stability and stiffness of the finished assembly.

Wall unit 8 is also provided with wall connection mechanisms to lock one wall unit 8 to the adjacent wall unit 8. One of side edges 54 or 56 is provided with locking tabs 60 and the other side edge is provided with a first set of mating slots 62 and a second set of mating slots 64. In the illustrated embodiment the left side of the wall units, as viewed in FIG. 8, is provided with the slots 62, 64 and the right side of the wall unit is provided with the locking tabs 60, although the placement of these components may be reversed. The locking tabs 60 are configured the same as locking tabs 20 and engage the slots 62, 64 as previously described with respect to the engagement of tabs 20 with slots 18 as described with reference to FIG. 7.

The first set of slots 62 is provided on a surface that is disposed substantially parallel to the plane of the face 58. As shown, a flange 66 extends along the side edge 54 substantially parallel to the face 58. The flange 66 is setback from the face 58 such that when the adjacent wall units 8 are fixed together the faces 58 of the wall units are substantially in a common plane. The slots 62 are spaced along the length of flange 66 such that they are disposed opposite to the locking members 60 formed on the opposite side edge 56. In this manner the locking members 60 of one wall unit are aligned with the slots 62 of the adjacent wall unit. The locking tabs 60 are inserted into slots 62, as previously described, and the tabs 60 are pushed in to the slots 62 to lock the wall units together using a snap-fit connection as shown in FIG. 10.

Figure 13:
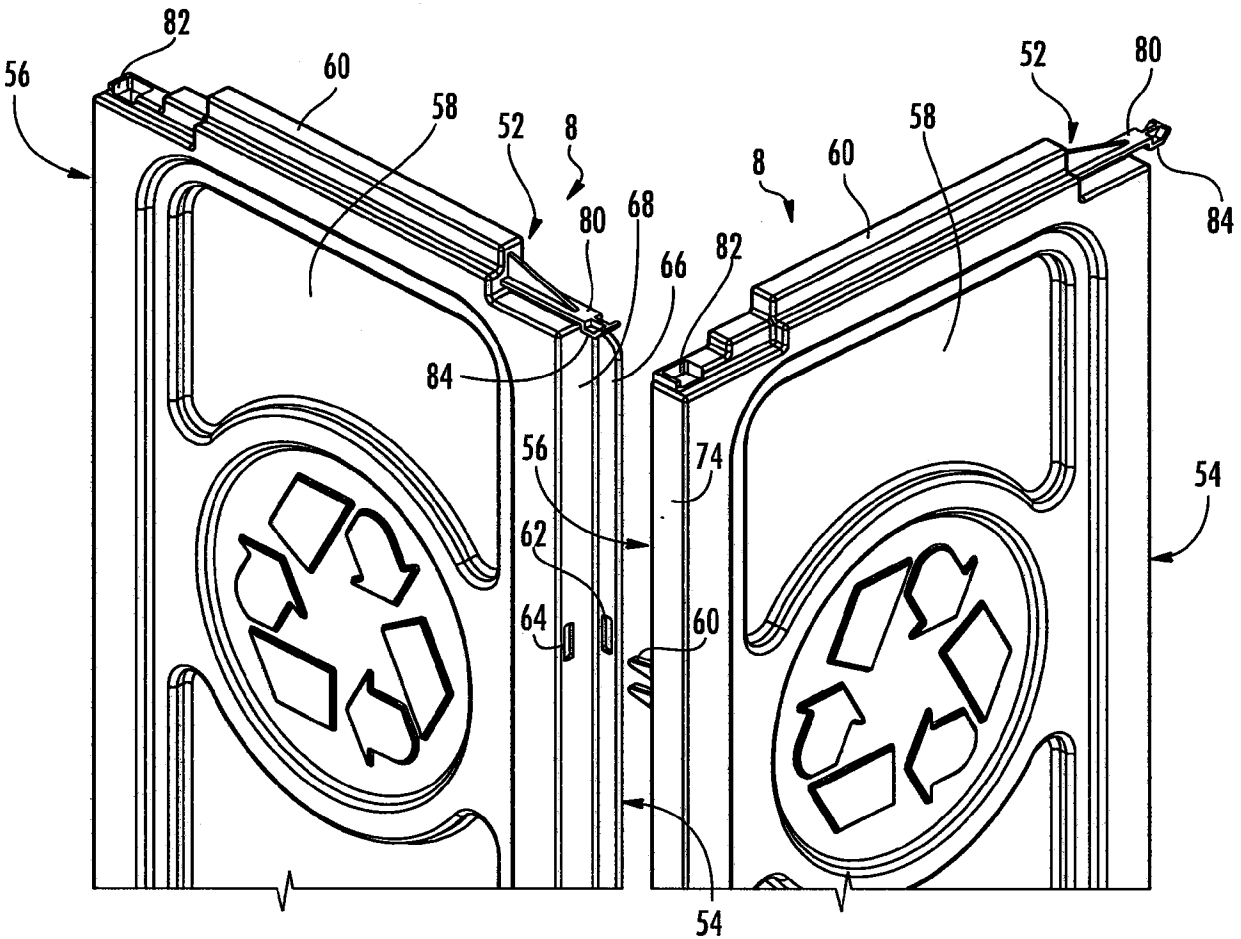
FIG. 13 is a partial perspective view showing the connection mechanism between wall units arranged at right angles to one another.
Figure 14:
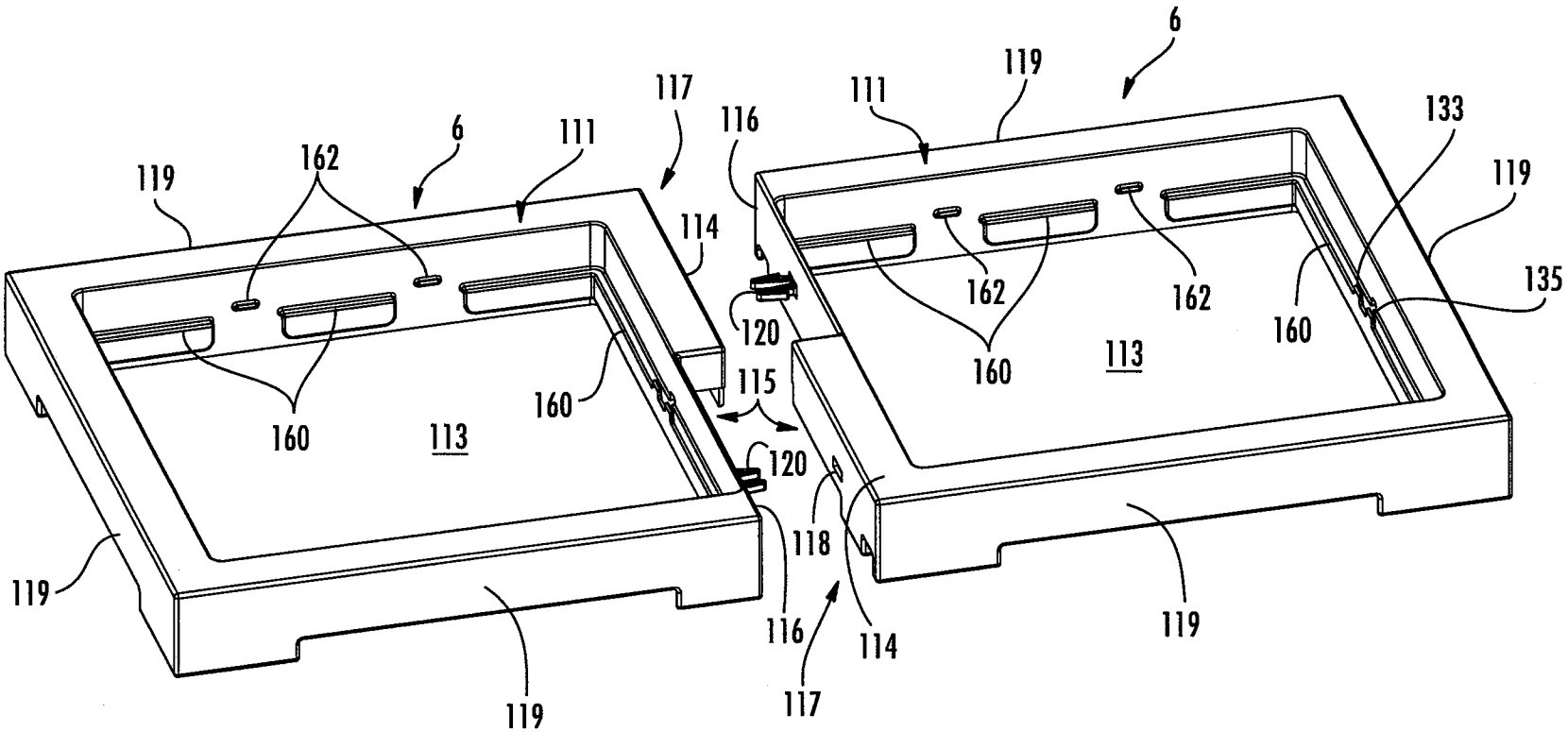
FIG. 14 is a perspective top view of an embodiment of the top units used in the system.
Figure 15:
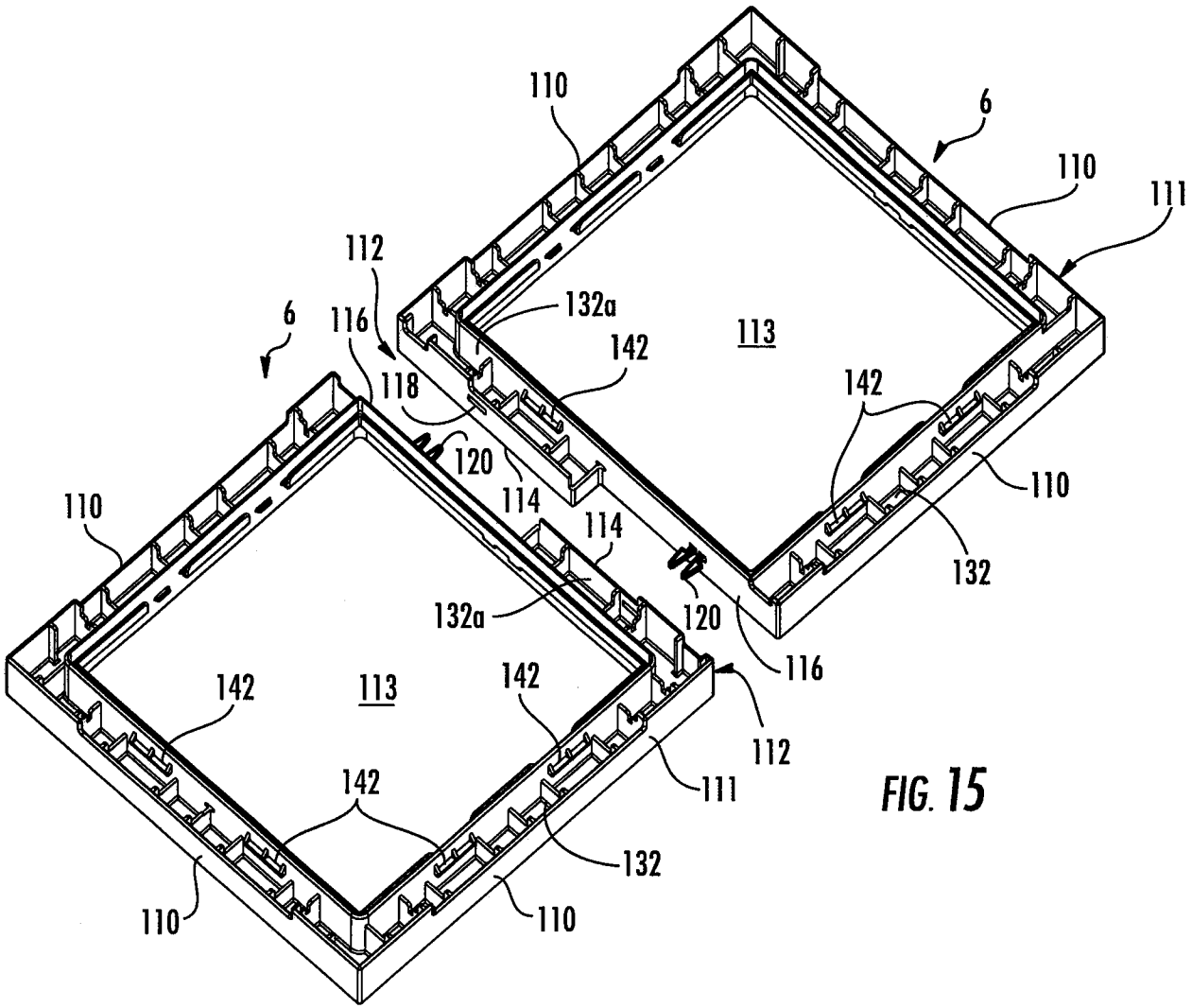
FIG. 15 is a perspective bottom view of an embodiment of the top units used in the system.

Referring to FIGS. 8, 9 and 13, the second set of slots 64 is provided on a surface that is disposed substantially perpendicular to the face 58 of the wall unit 8. The slots 64 are spaced along the length of sidewall 68 where side wall 68 is disposed substantially perpendicular to face 58. The slots 64 are arranged such that they are disposed opposite to the locking members 60 formed on the opposite side edge 56. In this manner the locking members 60 of one wall unit are aligned with the slots 64 of the adjacent wall unit. To insert the locking tabs 60 in slots 64, one wall unit is rotated 90 degrees relative to the adjacent wall unit as shown in FIG. 13, and locking tabs 60 are inserted into slots 64 as previously described to lock the wall units together as previously described. When locking tabs 60 engage slots 62 the wall units are arranged at right angles to one another to create an external corner. Flange 66 is received in slots 70 formed in braces 72. The sidewall 74 of one wall unit is disposed in substantially the same plane as the face 58 of the adjacent wall unit.

Figure 11:
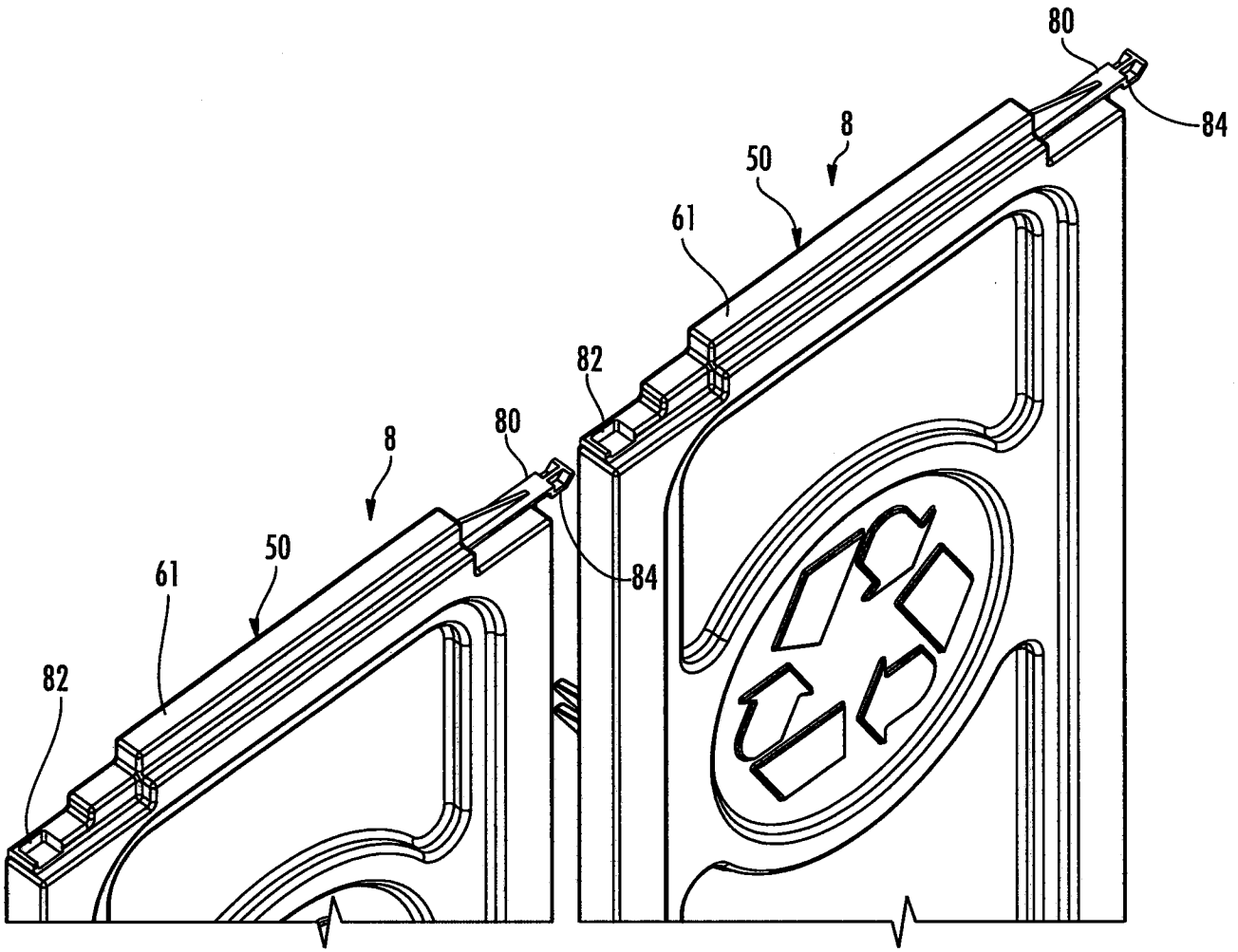
Figure 12:
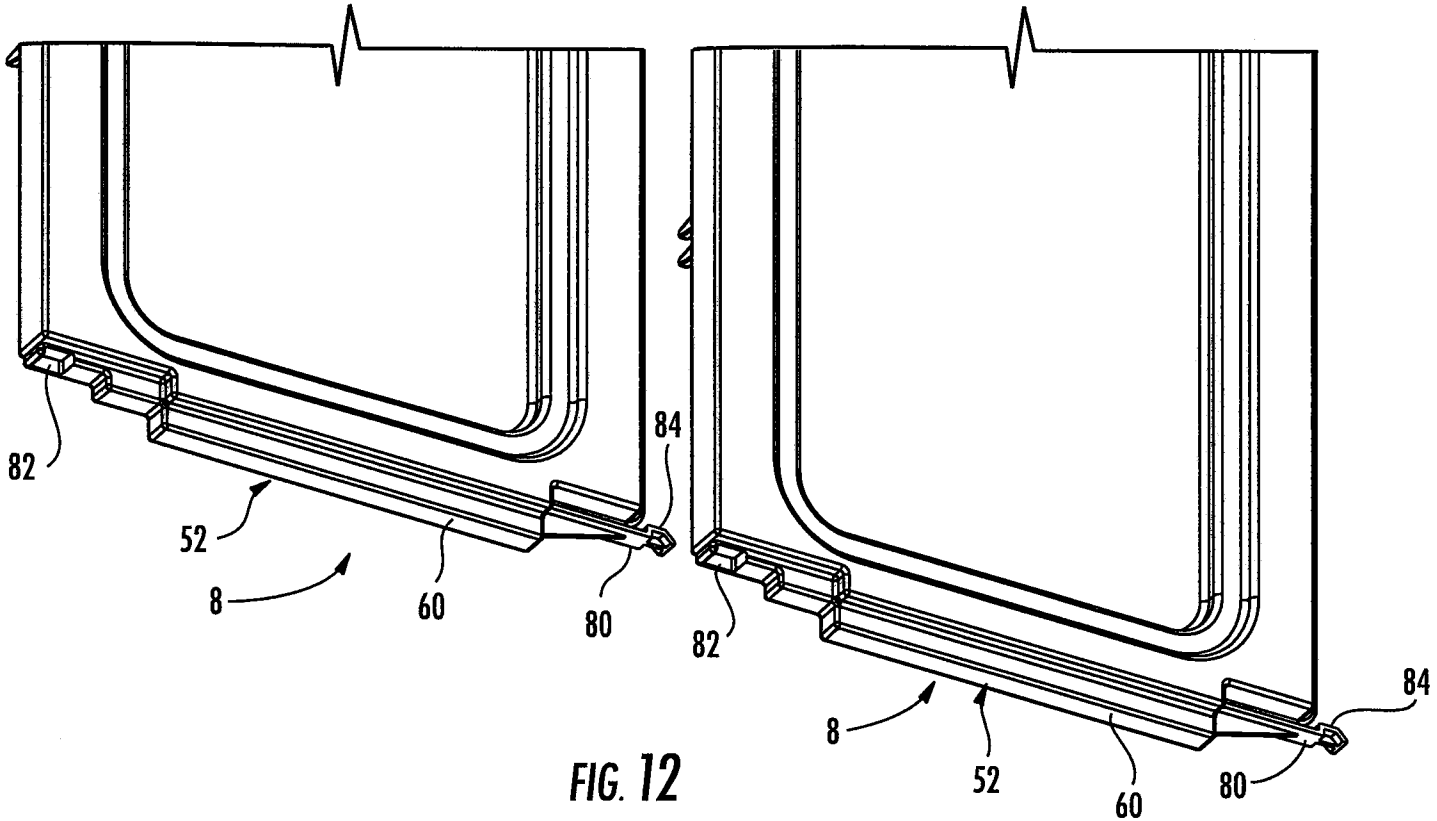

In addition to the locking tabs 60 and slots 62, 64, the wall units 8 are also connected together by upper and lower latches. Referring to FIGS. 8, 11 and 12, one side of top edge 50 is provided with a latch 80 and the opposite side of top edge 50 is provided with a mating recess 82. Likewise, one side of bottom edge 52 is provided with a latch 80 and the opposite side of bottom edge 52 is provided with a mating recess 82.

The latch 80 is formed as a resilient member that extends beyond the end of the wall unit on which it is mounted. The latch 80 can flex slightly away from the wall unit and returns to its original undeformed position relying on the resiliency of latch material. Alternatively, the latch could be biased by a separate component such as a spring hinge. Referring to FIG. 11, the recess 82 is formed on the top edge 50 of the wall unit 8 in a position where, when the wall units are mounted on a base unit in the assembled system the recess 82 is disposed under the latch 80. Likewise, referring to FIG. 12, the recess 82 is formed on the bottom edge 52 of the wall unit 8 in a position such that, when the wall units 8 are mounted on a base unit in the assembled system, the recess 82 is disposed over the latch 80. The latch 80 is formed with a protrusion 84 that extends toward and is closely received in recess 82. The engagement of the protrusion 84 with the recess 82 locks the upper and lower edges of the wall units 8 to one another.

Figure 20C:
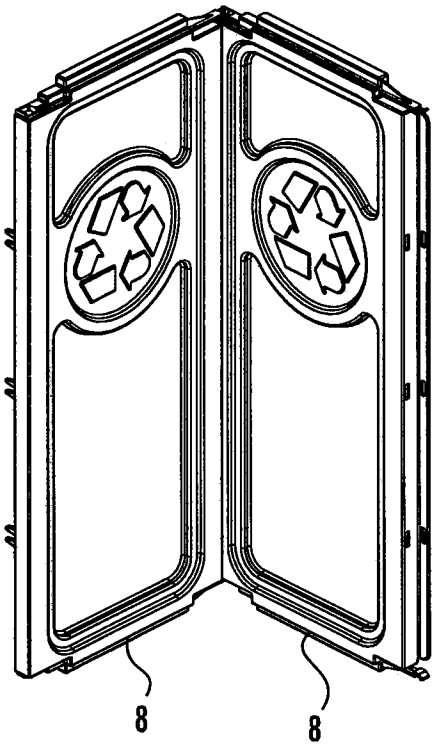
FIGS. 20*a*, 20*b*, and 20*c* are perspective views showing configurations of the wall units.
Figure 20B:
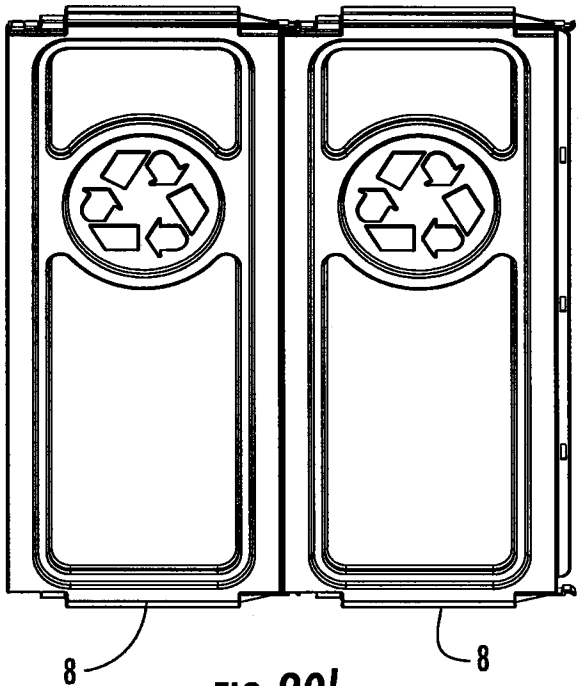
Figure 20A:
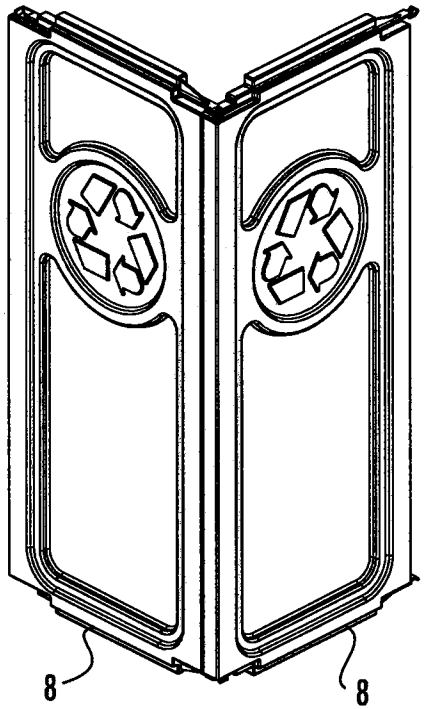

Referring to FIGS. 20*a*, 20*b* and 20*c* the wall units 8 can be connected together to form a straight wall section, FIG. 20*b*, an outside corner, FIG. 20*a* or an inside corner, FIG. 20*c*. To form an inside corner, shown in FIG. 20*c*, only the top and bottom latches 80 are used to secure the wall units 8 directly to one another, the locking tabs 60 do not engage slots 62 or 64. To connect the wall units to one another along their length separate clips or other connecting mechanisms may be used if desired.

Referring again to FIG. 9, after the wall units 8 are assembled on the base units, inside wall panels 90 may be added to make the interior walls of the assembled system smooth and to facilitate bag liner removal. The interior panels 90 may also be located between the units to keep the bag liners from expanding into adjacent spaces such that removal of the full bag liners through the top units is made easier. The wall panel 90 comprises a substantially planar member dimensioned to be substantially coextensive with a wall unit 8. The wall panel 90 may include two tabs 92 extending from the bottom edge thereof. The tabs 92 engage slots 44 formed on the base units. The tabs 92 may be formed with slots 94 that accommodate the reinforcement webs 63. The upper edge of the panels 90 are trapped under the top units 6 to secure the panels in position.

Referring to FIG. 1, decorative inserts 100 made of metal, plastic or other material may be attached to the outer face 58 of the wall units 8 and lids 170 to change or enhance the aesthetics of the unit or to provide information to the user. The inserts may be glued, snap fit, friction fit, secured by fasteners or otherwise attached to the wall units. The inserts 100 may be made to correspond to the molded indicia 101, as shown in FIG. 1, to further enhance the aesthetics of the unit or to communicate information.

Referring to FIGS. 14 through 18 the top unit 6 comprises a frame 111 that has substantially the same dimensions and the same basic connection devices as the corresponding base unit. The top unit has finished faces 119 and connecting faces 117 having top connection mechanisms 115. The top connection mechanism 115 comprises the interdigitated recessed section 116 and protruding section 114, and the locking tabs 120 and slots 118 for locking adjacent top units together. The slots 118 and tabs 120 are arranged with the tab 120 of one top unit disposed directly opposite the slot 118 of the adjacent top unit such that when the adjacent top units are brought into engagement with one another the tab 120 of one top unit enters and engages the slot 18 of the adjacent top unit, as described with reference to the base connection. The adjacent top units can be fixed to one another simply by pushing the top units toward one another to engage the locking tabs 120 with the opposed slots 118 using a "snap-fit" connection.

The top unit 6 also includes a wall connector comprising a downwardly facing channel 132 that receives the top edge 50 of the wall units 8 and a locking mechanism 142 that engages the flange 61 formed along the top edge of the wall units 8 in the same manner that the base unit engages the bottom edge of the wall unit. The top edge 50 is formed with a top flange 61 that can resiliently deform such that when the top edge 50 is placed into channel 132 and a downward force is applied to the top unit, the top flange 61 deforms and is forced around locking members 142 until the top edge is seated in the top of channel 132. Locking members 142 are spaced from the top of channel 132 such that the top flange 61, after it has cleared locking members 142, can return to its undeformed state where it is located under locking members 142. The engagement of locking members 142 with top flange 61 locks the wall units 8 into the top units using a snap-fit connection.

The frame 111 defines an opening 113 that is located over the containers in the assembled system. The frame 111 can support a trash bag, bag liner or other removable receptacle (bag liner) such that items placed into the opening will fall into the bag liner. The bag liner is typically a disposable plastic bag that can be removed and discarded when filled with items such as trash, recyclables or the like. The bag liner is typically supported such that the opening of the bag liner extends around the periphery of the opening 113. The bag liner may be supported, for example, on hooks disposed about the periphery of opening 113 or it may be draped over a rim that extends about the periphery of opening 113. In the illustrated embodiment bales 134, 136 are used to support the bag liner.

Figure 18:
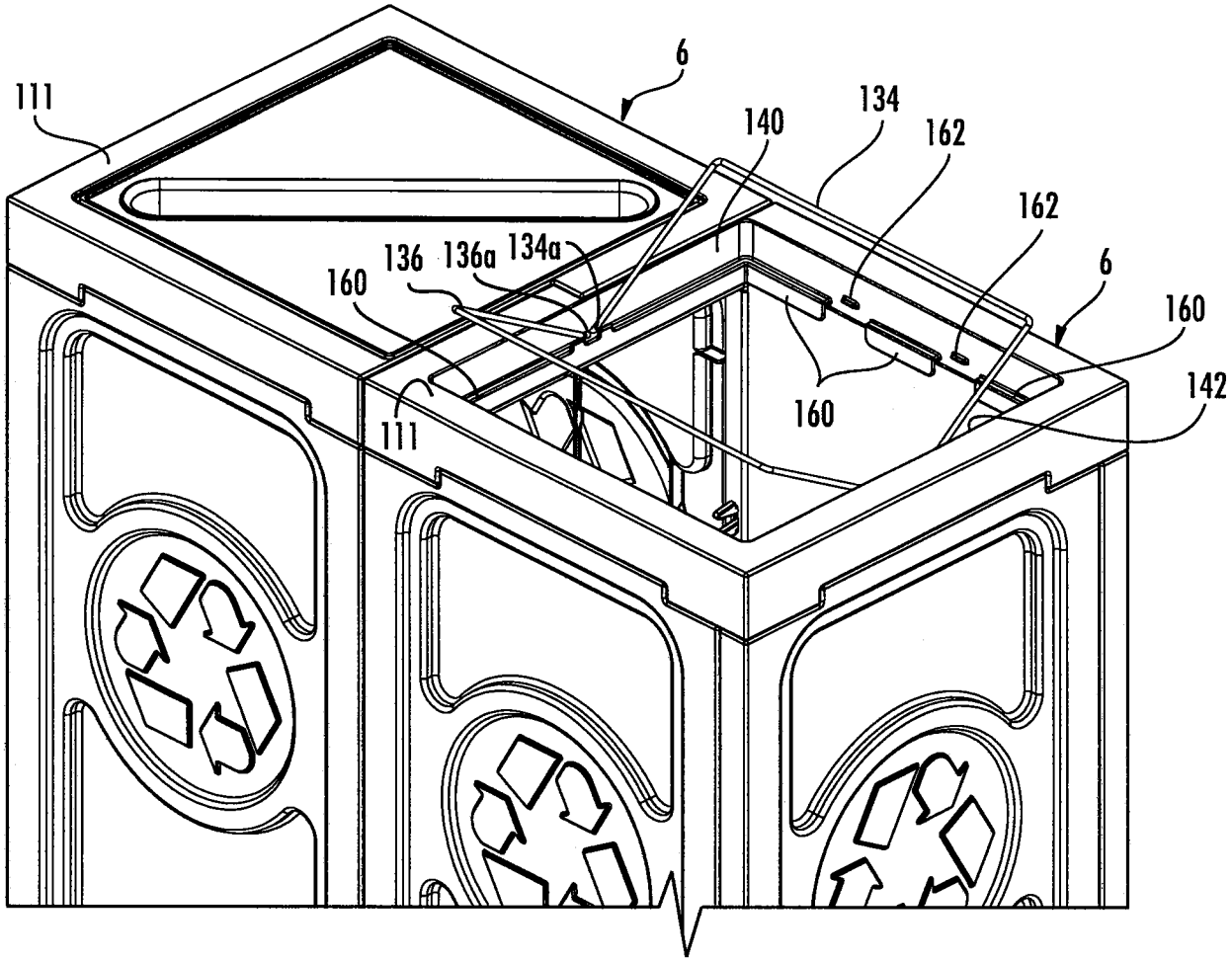
FIG. 18 is a perspective view showing details of an embodiment of a top unit in an assembled system.

Referring to FIG. 18 the bag liner is supported by a first bale 134 and a second bale 136. Bale 134 extends around approximately half of the periphery of opening 113 and bale 136 extends around approximately the other half of the periphery of opening 113. While in the illustrated embodiment the bales extend for substantially the entire periphery of opening 113 the bales could extend for less than the entire periphery. In such an arrangement the bag liner is stretched over the bales 134, 136 to hold it in position along the unsupported areas. Further, the bales may be used in addition to other supports such as hooks.

Bale 134 has ends 134*a* that extends substantially perpendicularly to a first side wall 140 and to the opposite side wall 142 of opening 113. The ends 134*a* of bale 134 are located in holes 133 formed in side walls 140 and 142, such that the bale 134 can pivot relative to the frame 111 about an axis that extends between its two ends. The bale 134 is configured to extend along the periphery of the opening 113. Likewise, the ends 136*a* of the bale 136 are located in holes 135 formed in side walls 140 and 142 adjacent holes 133, such that bale 136 can pivot relative to the frame about an axis that extends between the its two ends. Bale 136 is also configured to extend along the periphery of the opening 113. In the illustrated embodiment the bales 134, 136 comprise metal rods bent into the desired shape. The rods may also comprise molded plastic components or be made of other rigid material.

Formed along the periphery of the opening 113 is a ledge 160 that supports the bales 134 and 136, the bag liner and any collected waste items. The ledge 160 is located below the pivot axes of bales 134 and 136 such that when the bales are rotated down to the "in-use" position, the bales are supported in a substantially horizontal position on top of the ledge 160. Locking members 162, formed as protrusions extending from walls 140 and 142, are spaced from the ledge 160 a distance approximately equal to the thickness of the bales. When a bale is rotated down, the bale passes over the locking members 162. The locking members 162, the bales 134, 136 or both deform slightly to allow the bales to move past the locking members 162 until they rest on ledge 160. Once the bales 134, 136 clear the locking members 162 the bales, locking members 162 or both return to the undeformed state such that the bales are trapped between the ledge 160 and the locking members 162. The bales can be rotated up to the release position by reversing the process and forcing the bale back over the locking members 162. To facilitate the unlocking of the bale, the ledge 160 is interrupted in the areas below the locking members 162 to allow a user to grasp the bales.

In use, the bales 134 and 136 are moved to the release position where the bales are free from the locking members 162 as shown in FIG. 18. The top open end of a bag liner is draped over bales 134 and 136. The bales 134 and 136 are rotated to the "in-use" position by forcing the bales and the draped bag past the locking members 162 and onto the ledge 160. The bag liner and the bales 134 and 136 are held in the "in-use" position by the locking members 162. To remove the bag liner, the bales 134 and 136 are forced upward past the locking members 162, the bag liner is removed from the bales and a replacement bag liner may be suspended on the bales as previously described. The bag liners are suspended from the bales on the interior of the assembled system such that each subsystem may support a bag liner such that discarded items can be separated from one another.

Figure 17:
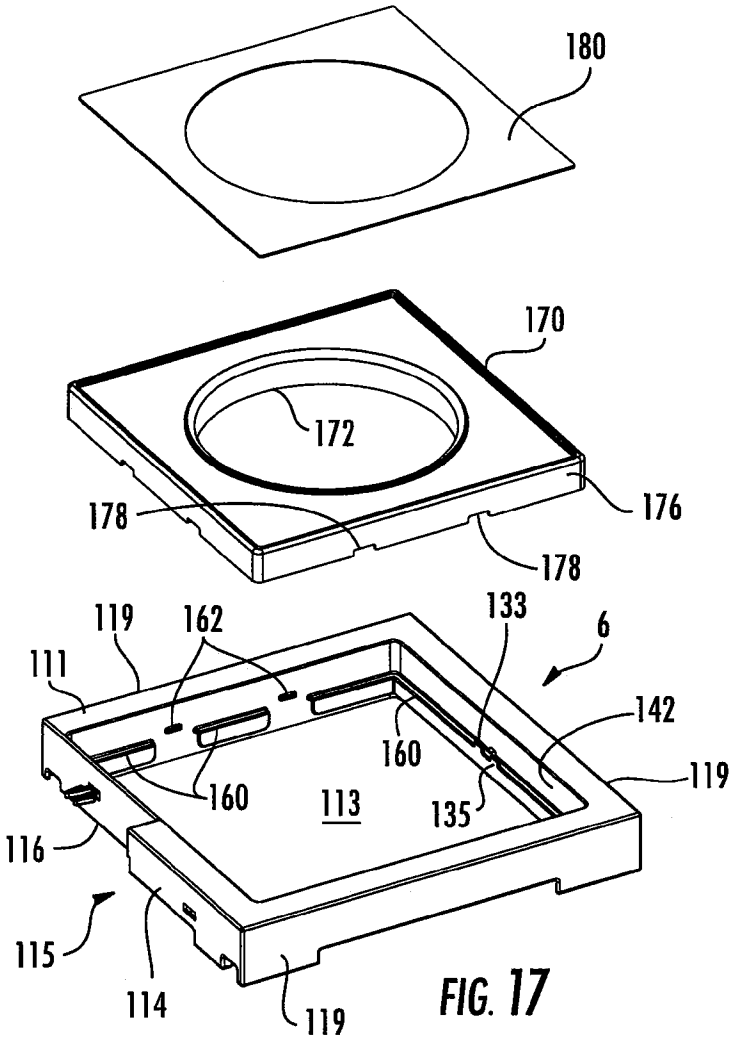
FIGS. 16 and 17 are perspective views show embodiments of the top units.
Figure 16:
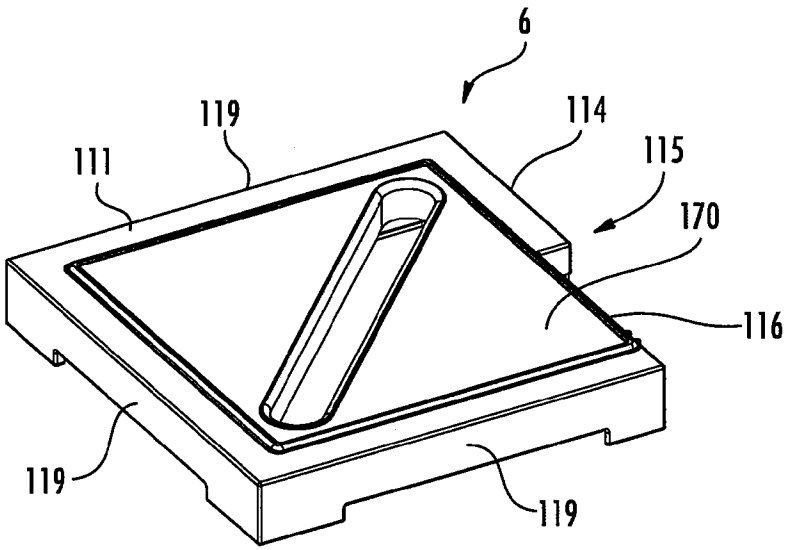

Referring to FIGS. 16 and 17, each top unit may also include a lid 170 that covers the opening 113. The lid 170 may include various sizes and shapes of openings to differentiate waste streams (bottles, cans, papers etc.) The illustrated embodiments show a round opening 172 and a slotted opening 174 but any size and shape opening may be used. The opening 172, 174 in the lid 170 communicates with the opening 113 in the frame 111 such that items inserted into the opening 172, 174 in lid 170 will fall directly into the bag liner supported in opening 113.

The lid 170 is removable to allow access to the bag liner, bales 134 and 136 and the interior of the assembled system. In the illustrated embodiment the lid 170 is dimensioned to be closely received in opening 113 and is simply dropped into or lifted from opening 113. The lid 170 includes a downwardly extending rim 176 that rests on top of the bales 134 and 136 and/or ledge 160 when the lid is closed. Notches 178 are formed in the rim 176 to accommodate the locking members 162. While the illustrated lids are "drop-in" type lids, the lids may also be hinged to the frame 111. Decorative inserts 180 made of metal, plastic or other material may be attached to the outer surface of the lids to enhance or change the aesthetics of the unit or to provide information to the user. The inserts 180 may be glued, snap-fit, friction fit, secured by fasteners or otherwise attached to the top units.

Figure 19:
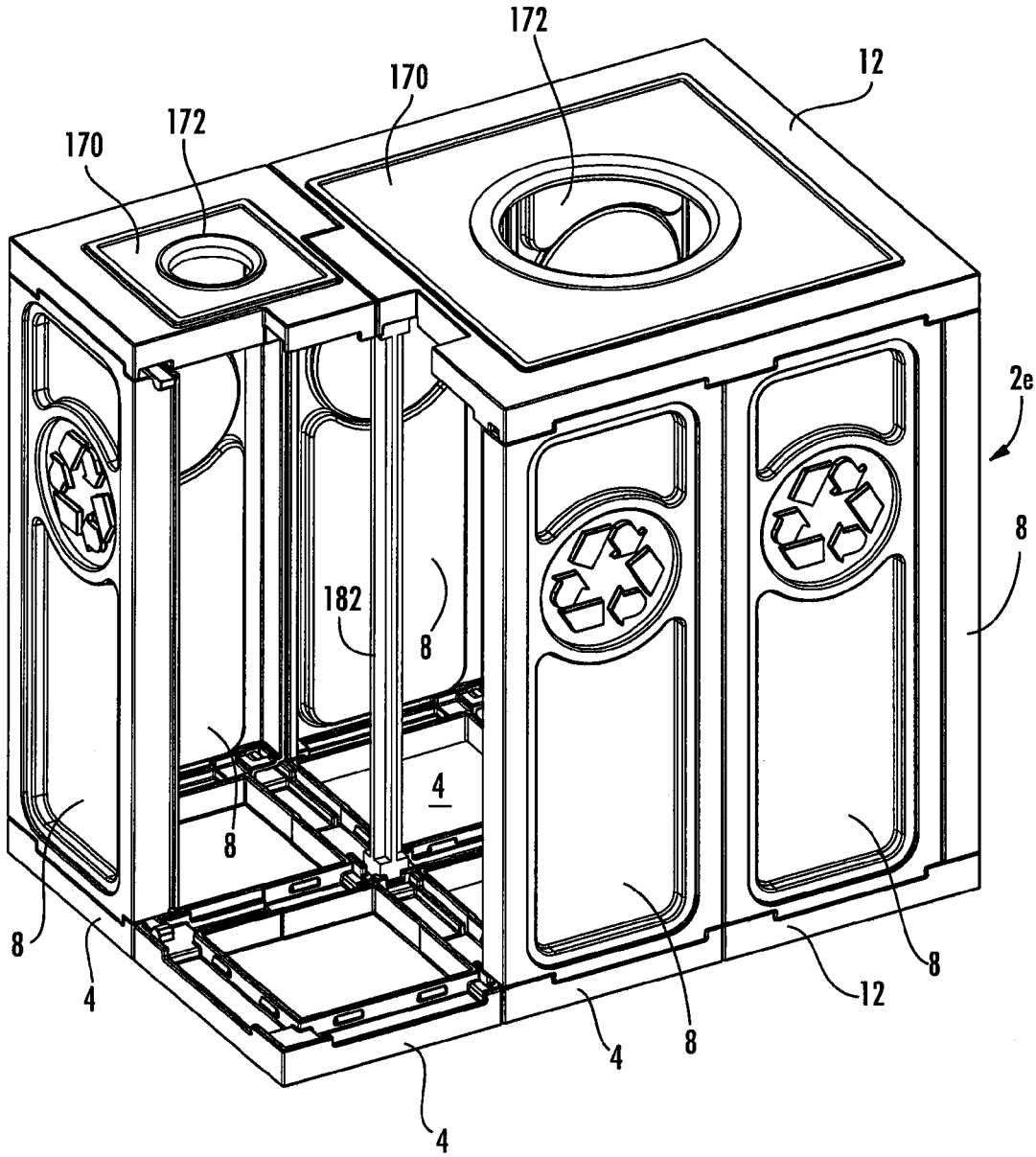
FIG. 19 is a perspective view showing details of an embodiment of a partially assembled system.

Referring to FIG. 19, a partially assembled system is shown. The interior of the assembly does not need to include any wall panels 90 and may be left open. Support columns 182 may be used to support the top units in large systems. The support columns 182 clip to the base units and top units to reinforce the system. Support columns 182 also constrain the side edges of the interior wall panels 90.

Figure 21:
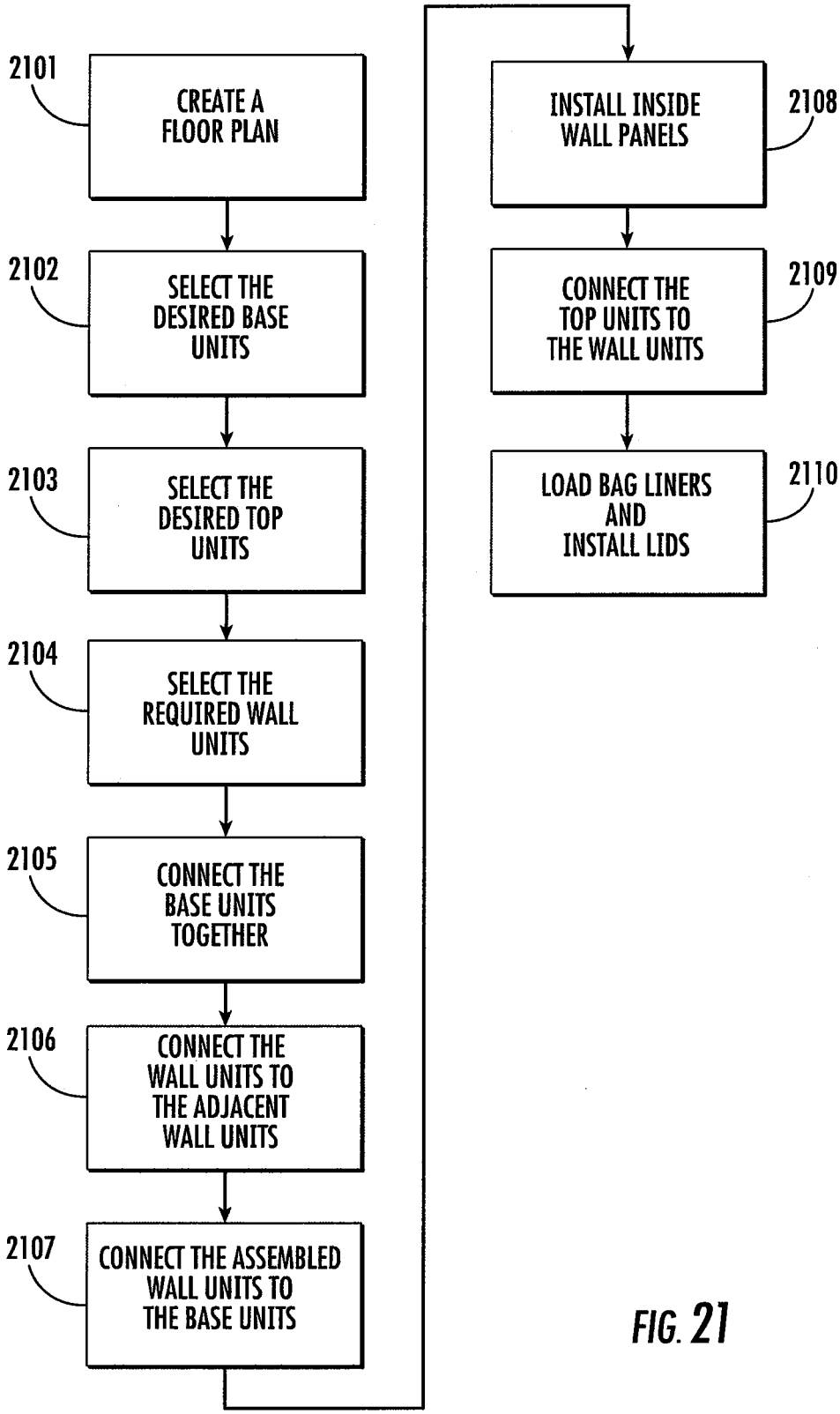
FIG. 21 is a block diagram illustrating an embodiment of a method of assembling the system of the invention.

Referring to FIG. 21, a method of making the assembled system will now be described. A floor plan of the complete assembly is made (block 2101). The floor plan lays out the overall size and shape of the complete assembly, examples being illustrated in FIGS. 6*a*-6*i*. In addition to laying out the overall size and shape of the complete assembly, the floor plan also identifies the sizes and shapes of the subassemblies, e.g. whether four one unit subassemblies or one four unit assembly is to be used. The floor plan also identifies which type of subsystem is to be used (e.g. corner 4*c*, wall 4*w*, interior 4*i*, end 4*e* or double outside wall 4*d*). The floor plan may be laid out graphically, e.g. using paper and pencil or computer based such as a CAD program, or the floor plan may be laid out physically using actual base units. Further, the assembly, rather than being laid out in a complete plan, could be built up on site subassembly by subassembly until a complete assembly is created. A plurality of base units, including at least one type of base unit from the different types of base units, is selected (block 2102). A plurality of top units, including at least one type of top unit from the different types of top units, is selected (block 2103). The appropriate number of wall units needed to complete the outside wall of the assembly are selected (block 2104). The selected base units are located on a support surface and are connected together by pushing the opposed connecting faces 17 toward one another until the locking tabs 20 engage slots 18 (block 2105). The adjacent wall units are engaged with one another by pushing locking tabs 60 into engagement with slots 62 or 64 and by engaging latches 80 with recesses 82 (block 2106). The selected assembled wall units are then connected to the base units by pushing each wall 8 unit into the channel 32 until the locking members 42 engage the lower flanges 60 (block 2107). The inside wall panels 90 may also be installed (block 2108). The selected top units are pushed onto the wall units until the upper edges of wall units 8 are seated in channels 132 and locking members 142 engage the upper flanges 61 of the wall units (block 2109). The bag liners are loaded as previously described and the lids 170 are placed on the frame members 111 to complete the system (block 2110). The decorative panels may be installed by the manufacturer or they may be inserted by the user on site.

The system allows a wide variety of complete assemblies having various shapes, sizes and configurations to be made from a limited number of components. The system can be assembled without tools using the snap-fit connections quickly and easily and once assembled forms a strong semi-permanent waste handling system. The system also allows the user interface to be modified using different lid shapes, decorative panels and configurations.

This asymmetrical top connection mechanism 115 and base connection mechanism 15 and modular units allows the end user to construct a uniform recycling system of different shapes and sizes. The system of the invention allows end users to customize their containers to meet their particular requirements based on size, shape, number of trash openings and recycling type. The design clearly communicates "recycling" from a good distance away from a user. The communication is integrated into the system's architectural design fitting into an institution's aesthetic requirements.

While embodiments of the invention are disclosed herein, various changes and modifications can be made without departing from the spirit and scope of the invention as set forth in the claims. One of ordinary skill in the art will recognize that the invention has other applications in other environments. Many embodiments are possible.

The invention claimed is:

1. A recycling/waste assembly comprising:

a plurality of base units, each of said plurality of base units comprising a plurality of sides and comprising at least one base connection mechanism on one of said plurality of sides for connecting each of said plurality of base units to another one of said plurality of base units, each of said plurality of base units having a first wall connector for connecting each of said plurality of base units to at least one of a plurality of wall units;

a plurality of top units, each of said plurality of top units comprising a plurality of sides and comprising at least one top connection mechanism on one of said plurality of sides for connecting each of said plurality of top units to another one of said plurality of top units, each of said plurality of top units having a second wall connector for connecting each of said plurality of top units to at least one of said plurality of wall units, each of said plurality of top units comprising an opening for receiving discarded material; and a plurality of substantially planar wall units each having a top edge, a bottom edge, a first side edge and a second side edge, each of said plurality of wall units comprising a bottom edge structure engageable with said first wall connector and a top edge structure engageable with said second wall connector, each of said plurality of wall units further comprising a plurality of locking tabs along said first side edge, a first set of slots and a second set of slots along the second side edge, the first set of slots being on a surface that is substantially parallel to a face of the wall unit so that when the locking tabs engage the first set of slots the wall units are in a common plane, and the second set of slots being on a surface that is substantially perpendicular to the face of the wall unit so that when the locking tabs engage the second set of slots the wall units are arranged at right angles to one another to create an external corner.

2. The assembly of claim 1 wherein said base connection mechanism comprises a slot and a flexible locking tab positioned such that the locking tab of one of the plurality of base units is disposed directly opposite the slot of an adjacent base unit.

3. The assembly of claim 2 wherein the base connection mechanism fixes one of said plurality of base units to the adjacent base unit by moving the one of said plurality of base units toward the adjacent base unit.

4. The assembly of claim 3 wherein the locking tab comprises a resilient finger that engages the slot when the one of said plurality of base units is moved into engagement with the adjacent base unit.

5. The assembly of claim 1 wherein said first wall connector comprises a channel that receives the bottom edge.

6. The assembly of claim 1 wherein said first wall connector includes a locking member that engages a flange on said wall unit.

7. The assembly of claim 1 further comprising a latch adjacent the first side edge and a recess engageable by said latch adjacent the second side edge for connecting each of said plurality of wall units to another one of said plurality of wall units.

8. The assembly of claim 7 wherein the latch is a resilient member that extends beyond the first side edge.

9. The assembly of claim 1 further including a wall panel mounted to an inside surface of said plurality of wall units.

10. The assembly of claim 9 wherein said wall panel is dimensioned to be coextensive with one of said plurality of wall units.

11. The assembly of claim 1 further including decorative inserts attached to a face of the plurality of wall units.

12. The assembly of claim 1 wherein said plurality of base units, said plurality of wall units and said plurality of top units are made of molded plastic.

13. The assembly of claim 1 wherein one of said plurality of top units include a first bale and a second bale pivotably mounted to one of said plurality of top units.

14. The assembly of claim 13 wherein said first bale extends for a first portion of a periphery of the opening and the second bale extends for a second portion of the periphery of the opening.

15. The assembly of claim 13 further including a ledge that supports the first bale and the second bale.

16. The assembly of claim 15 further including locking members formed as protrusions extending from a wall in the one of said plurality of top units for trapping the first bale and the second bale against the ledge.

17. The assembly of claim 1 further including a lid for selectively covering said opening.

18. The assembly of claim 17 wherein said lid includes a second opening.

19. The assembly of claim 17 further including decorative inserts attached to a face of said lid.

20. The assembly of claim 1 further including a support column extending between one of said plurality of base units and one of said plurality of top units.

21. A recycling/waste assembly comprising:

a first base unit comprising a first base connection mechanism and a first wall connector and a second base unit comprising a second base connection mechanism and a second wall connector, said first base connection mechanism including a first tab and a first slot and said second base connection mechanism including a second tab and a second slot arranged such that the first tab engages the second slot and the second tab engages the first slot by moving the first base unit toward said second base unit to lock the first base unit to the second base unit;

a first top unit comprising a first opening, a first top connection mechanism and a third wall connector and a second top unit comprising a second opening, a second top connection mechanism and a fourth wall connector, said first top connection mechanism including a third tab and a third slot and said second top connection mechanism including a fourth tab and a fourth slot arranged such that the third tab engages the fourth slot and the fourth tab engages the third slot by moving the first top unit toward said second top unit to lock the first top unit to the second top unit; and a plurality of substantially planar wall units each having a top edge, a bottom edge, a first side edge and a second side edge, each of said plurality of wall units comprising a bottom edge structure engageable with said first wall connector and said second wall connector and a top edge structure engageable with said third wall connector and said fourth wall connector, each of said plurality of wall units further comprising a plurality of locking tabs along said first side edge, a first set of slots and a second set of slots along the second side edge, the first set of slots being on a surface that is substantially parallel to a face of the wall unit so that when the locking tabs engage the first set of slots the wall units are in a common plane, and the second set of slots being on a surface that is substantially perpendicular to the face of the wall unit so that when the locking tabs engage the second set of slots the wall units are arranged at right angles to one another to create an external corner.

22. The recycling/waste assembly of claim 1 wherein at least one of the plurality of base units and the plurality of top units further comprises a larger unit and a smallest unit, wherein the larger unit is an integer multiple of the smallest unit in size.

23. The recycling/waste assembly of claim 21 wherein the first top unit is an integer multiple of the second top unit in size.

24. The recycling/waste assembly of claim 23 wherein one of the first base unit and the second base unit is an integer multiple of the other of the first base unit and the second base unit in size.

25. A recycling/waste assembly comprising:

a plurality of base units, each of said plurality of base units comprising a plurality of sides and comprising at least one base connection mechanism on one of said plurality of sides for connecting each of said plurality of base units to another one of said plurality of base units, each of said plurality of base units having a first wall connector for connecting each of said plurality of base units to at least one of a plurality of wall units;

a plurality of top units, each of said plurality of top units comprising a plurality of sides and comprising at least one top connection mechanism on one of said plurality of sides for connecting each of said plurality of top units to another one of said plurality of top units, each of said plurality of top units having a second wall connector for connecting each of said plurality of top units to at least one of said plurality of wall units, each of said plurality of top units comprising an opening for receiving discarded material;

a plurality of substantially planar wall units each having a top edge, a bottom edge, a first side edge and a second side edge, each of said plurality of wall units comprising a bottom edge structure engageable with said first wall connector and a top edge structure engageable with said second wall connector, each of said plurality of wall units further comprising a plurality of locking tabs along said first side edge, a first set of slots and a second set of slots along the second side edge, the first set of slots being on a surface that is substantially parallel to a face of the wall unit so that when the locking tabs engage the first set of slots the wall units are in a common plane, and the second set of slots being on a surface that is substantially perpendicular to the face of the wall unit so that when the locking tabs engage the second set of slots the wall units are arranged at right angles to one another to create an external corner; and a wall panel mounted to an inside surface of at least one of said plurality of substantially planar wall units, wherein said wall panel is substantially the same dimensions as one of said plurality of substantially planar wall units.

* * * * *